US008899048B2

(12) United States Patent
Prociw et al.

(10) Patent No.: US 8,899,048 B2
(45) Date of Patent: Dec. 2, 2014

(54) LOW CALORIFIC VALUE FUEL COMBUSTION SYSTEMS FOR GAS TURBINE ENGINES

(75) Inventors: Lev Alexander Prociw, Johnston, IA (US); Andy W. Tibbs, Earlham, IA (US)

(73) Assignee: Delavan Inc., West Des Moines, IA (US)

( * ) Notice: Subject to any disclaimer, the term of this patent is extended or adjusted under 35 U.S.C. 154(b) by 921 days.

(21) Appl. No.: 12/954,008

(22) Filed: Nov. 24, 2010

(65) Prior Publication Data

US 2012/0125008 A1 May 24, 2012

(51) Int. Cl.

| | |
|---|---|
| ***F02C 1/00*** | (2006.01) |
| ***F23R 3/34*** | (2006.01) |
| ***F23R 3/36*** | (2006.01) |
| ***F23R 3/44*** | (2006.01) |
| ***F23R 3/54*** | (2006.01) |

(52) U.S. Cl.

CPC . *F23R 3/346* (2013.01); *F23R 3/36* (2013.01); *F23R 3/44* (2013.01); *F23R 3/54* (2013.01); *F23C 2201/20* (2013.01); *F23R 2900/00002* (2013.01)

USPC ..... 60/737; 60/739; 60/800

(58) Field of Classification Search

CPC ..... F02C 7/236; F02C 7/22; F02C 7/222; F02C 7/228; F02C 9/26; F23R 3/28; F23R 3/34; F23R 3/346; F23R 3/36; F23R 3/54; F23R 3/60; F23R 3/286; F23R 2900/0002

USPC ..... 60/734, 737, 739, 746, 799, 39.463, 60/800

See application file for complete search history.

(56) References Cited

U.S. PATENT DOCUMENTS

| | | | | |
|---|---|---|---|---|
| 2,607,193 | A | 8/1952 | Berggren et al. | |
| 3,680,793 | A | 8/1972 | Tate et al. | |
| 4,100,733 | A * | 7/1978 | Striebel et al. | 60/39.463 |

(Continued)

FOREIGN PATENT DOCUMENTS

| | | |
|---|---|---|
| EP | 0509496 A1 | 10/1992 |
| EP | 1398570 A2 | 3/2004 |
| EP | 1426689 A1 | 6/2004 |
| EP | 1605208 A1 | 12/2005 |

OTHER PUBLICATIONS

Partial search report dated Apr. 19, 2012 in connection with European application 11250766.0.

(Continued)

*Primary Examiner* — Phutthiwat Wongwian
*Assistant Examiner* — Alain Chau
(74) *Attorney, Agent, or Firm* — Edwards Wildman Palmer LLP; Scott D. Wofsy; Joshua L. Jones

(57) ABSTRACT

A combustion system for a gas turbine engine includes a housing defining a pressure vessel. A master injector is mounted to the housing for injecting fuel along a central axis defined through the pressure vessel. A plurality of slave injectors is included. Each slave injector is disposed radially outward of and substantially parallel to the master injector for injecting fuel and air in an injection plume radially outward of fuel injected through the master injector. The master injector and slave injectors are configured and adapted so the injection plume of the master injector intersects with the injection plumes of the slave injectors. The slave injectors can be staged for reduced power operation.

17 Claims, 19 Drawing Sheets

(56) References Cited

U.S. PATENT DOCUMENTS

| | | | | |
|---|---|---|---|---|
| 4,598,553 | A | 7/1986 | Saito et al. | |
| 5,235,814 | A | 8/1993 | Leonard | |
| 5,359,847 | A * | 11/1994 | Pillsbury et al. | 60/39.463 |
| 5,409,169 | A | 4/1995 | Saikalis et al. | |
| 5,713,206 | A | 2/1998 | McWhirter et al. | |
| 5,983,642 | A | 11/1999 | Parker et al. | |
| 6,092,363 | A | 7/2000 | Ryan | |
| 6,360,525 | B1 | 3/2002 | Senior et al. | |
| 6,363,726 | B1 | 4/2002 | Durbin et al. | |
| 6,533,954 | B2 | 3/2003 | Mansour et al. | |
| 6,622,488 | B2 | 9/2003 | Mansour et al. | |
| 6,688,534 | B2 | 2/2004 | Bretz | |
| 6,755,024 | B1 | 6/2004 | Mao et al. | |
| 6,772,583 | B2 | 8/2004 | Bland | |
| 6,854,670 | B2 | 2/2005 | Sumisha et al. | |
| 6,862,888 | B2 | 3/2005 | Akagi et al. | |
| 6,863,228 | B2 | 3/2005 | Mao et al. | |
| 6,871,488 | B2 | 3/2005 | Oskooei et al. | |
| 7,454,914 | B2 | 11/2008 | Prociw | |
| 7,509,811 | B2 | 3/2009 | Chen et al. | |
| 7,520,134 | B2 | 4/2009 | Durbin et al. | |
| 7,533,531 | B2 | 5/2009 | Prociw et al. | |
| 7,707,833 | B1 | 5/2010 | Bland et al. | |
| 7,926,178 | B2 | 4/2011 | Thomson et al. | |
| 7,926,282 | B2 | 4/2011 | Chew et al. | |
| 2006/0242965 | A1 * | 11/2006 | Shi et al. | 60/796 |
| 2008/0236165 | A1 * | 10/2008 | Baudoin et al. | 60/746 |
| 2009/0255258 | A1 | 10/2009 | Bretz et al. | |
| 2010/0139238 | A1 | 6/2010 | Hall et al. | |
| 2011/0031333 | A1 | 2/2011 | Short | |

OTHER PUBLICATIONS

DLN 2.6+ Combustion System for Frame 9FA, GE Energy Fact Sheet, GEA-14358 (Nov. 2005), 2005 General Electric Company.

Tacina, R, Mao, C., Wey, C., Experimental Investigation of a Multiplex Fuel Injector Module with Discrete Jet Swirlers for Low Emission Combustors, The NASA STI Program Office, NASA/TM 2004-212918, AIAA-2004-0185, Glenn Research Center, Aug. 2004.

Brun, K., Kurz, R., IGCC Combusion Challenges, Turbomachinery international, May/Jun. 2010 p. 52.

Paisley, M.A., Welch, M.J., Biomass Gasification Combined Cycle Opportunities Using the Future Energy Silvagas® Gasifier Coulpled to Alstom's Industrial Gas Turbines, Proceedings of ASME Turbo Expo 2003, ASME Turbo Expo Land, Sea and Air 2003, Georgia World Congress Center, Jun. 16-19, 2003, GT2003-38294.

Johnson, C., Pepperman, B., Keonig, M., Khalil, A., Gulati, A., Moradian, A., Hall, G., Ultra Low Nox Combustion Technology, Power-Gen International, Dec. 2008, Siemens Power Generation, Inc. 2008.

Energy Solutions for Combined Heat and Power, THM 1304-11 Gas Turbines to Total Solutions, MAN Turbomachinery Inc., Sep. 2003.

A copy of the Extended European Search Report for Application No. 11250766.0, dated Aug. 13, 2012.

Lee, C., et al., "High Pressure Low Nox Emissions Research: Recent Progress at NASA Glenn Research Center," ISABE-2007-1270 (2007).

Tacina, K.M., et al. "NASA Glenn High Pressure Low NOX Emissions Research," NASA/TM-2008-214974 (2008).

* cited by examiner

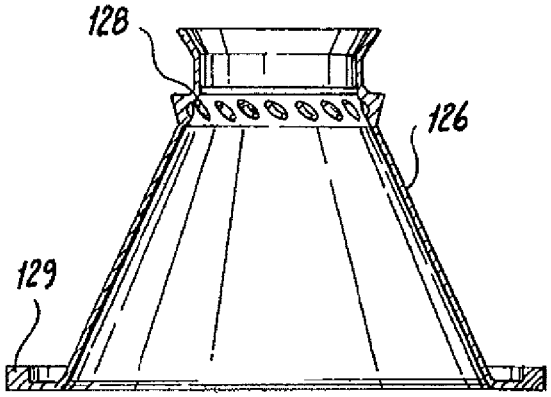
Fig. 7
Fig. 8
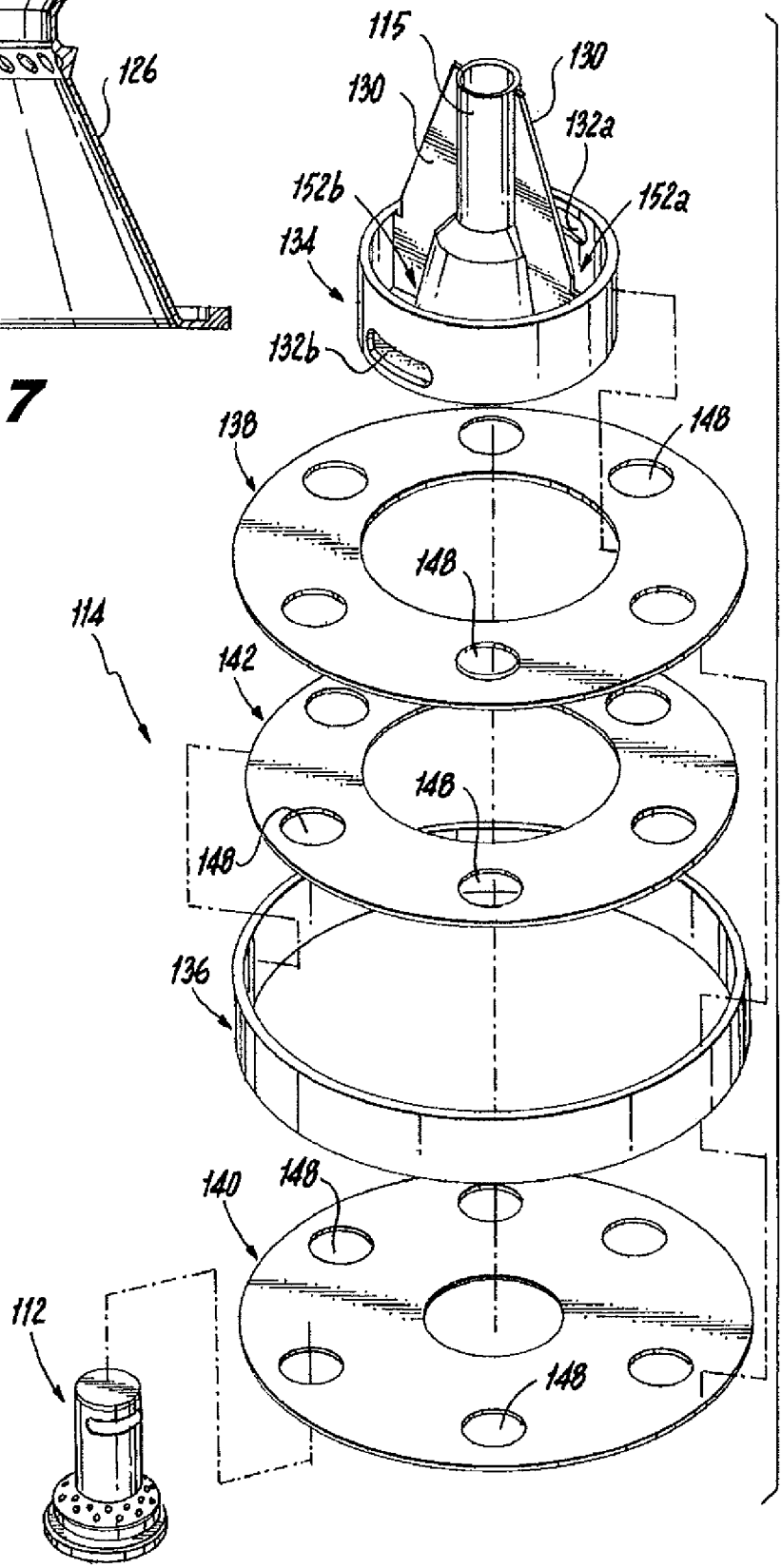

LOW CALORIFIC VALUE FUEL COMBUSTION SYSTEMS FOR GAS TURBINE ENGINES

BACKGROUND OF THE INVENTION

1. Field of the Invention

The present invention relates to gas turbine engines, and more particularly to gas turbine engines utilizing low calorific value fuels.

2. Description of Related Art

Gasification of coal, biomass, and other fuels produces fuel gas that can be used for power production. Fuel gas derived from gasification or other such processes is commonly referred to as low calorific value (LCV) fuel because it typically has significantly lower heating values compared to more traditional fuels. Whereas natural gas typically has a heating value of about 1,000 BTU/Ft$^3$, LCV gas can have a heating value on the order of only about 130 BTU/Ft$^3$ and less. LCV gas can be used with or as a replacement for more traditional fuels in applications including internal combustion engines, furnaces, boilers, and the like. In addition to environmental concerns, fluctuating fuel costs and availability drive a growing interest in use of LCV fuels where more traditional fuels, such as natural gas, are typically used.

While there is growing interest in LCV fuels, the low heating value of LCV fuel creates obstacles to its more widespread use. Thus there is an ongoing need for improved LCV fuel combustion systems. For example, the use of LCV fuel in an existing, conventional gas turbine engine requires special considerations regarding the fuel injection system. Flammability of LCV fuel gas can be unknown due to variables in the gasification process, so there is typically an unpredictable flameout limit when lowering fuel flow to operate at reduced power. Due to the relatively low heating value, LCV fuel can require 10 to 12 times the volumetric flow rate of natural gas for which the original engine was designed, which can give rise to capacity complications for traditional combustion systems. Typical gasification systems produce LCV fuel through high-temperature processes, and LCV fuel is often supplied directly from the gasification system. The LCV fuel temperature can be significantly hotter than in conventional fuel systems, which can give rise to further thermal management concerns. Additionally, due to the low calorific value, the fuel can present difficulties in terms of start up and flame stabilization.

Some solutions to these challenges have been proposed, such as using large numbers of small injectors, and allowing for mixing traditional fuel in with LCV fuel. However, the high flow rates needed to provide an adequate supply of LCV fuel lead to significant pressure drop, which is exacerbated by using large numbers of small injectors. High pressure drop can severely impact overall thermal efficiency for gas turbine engines, for example. Start up and flame stabilization challenges persist in typical LCV fuel injection systems.

Such conventional methods and systems have generally been considered satisfactory for their intended purpose. However, there is still a need in the art for combustion systems and methods that allow for improved start up, flame stability, and fuel staging. There also remains a need in the art for such systems and methods that are easy to make and use. The present invention provides a solution for these problems.

SUMMARY OF THE INVENTION

The subject invention is directed to a new and useful combustion system for gas turbine engines. The system includes a housing defining a pressure vessel. A master injector is mounted to the housing for injecting fuel along a central axis defined through the pressure vessel. A plurality of slave injectors is included. Each slave injector is disposed radially outward of and substantially parallel to the master injector for injecting fuel and air in an injection plume radially outward of fuel injected through the master injector. The master injector and slave injectors are configured and adapted so the injection plume of the master injector intersects with the injection plumes of the slave injectors.

In accordance with certain aspects, each slave injector has an outlet substantially in a common plane with the other slave injector outlets, and the master injector includes a diverging outlet that sets the master injector back upstream from the common plane of the slave injectors. In certain embodiments, a manifold within the pressure vessel is configured to separately distribute fuel to subsets of the slave injectors. The manifold can be configured to separately distribute fuel to two subsets of the slave injectors, or to any suitable number of subsets of the slave injectors.

Each slave injector can include an inlet port, wherein each injector in a first subset of the slave injectors includes an inlet port at a first level, and wherein each injector in a second subset of the slave injectors includes an inlet port at a second level. The first and second levels can be axially spaced along the central axis. The manifold can be configured to separately direct flow from a first inlet in the pressure vessel into the inlet ports at the first level and from a second inlet in the pressure vessel into the inlet ports at the second level to separately distribute flow to the two subsets of the slave injectors.

In certain embodiments, the manifold includes an upper manifold plate and an opposed lower manifold plate. The upper and lower manifold plates are mounted to the slave injectors and are axially spaced apart from one another along the central axis. The manifold includes a radially inner wall mounted to radially inner edges of the upper and lower manifold plates, and a radially outer wall mounted to radially outer edges of the upper and lower manifold plates. The radially inner wall of the manifold includes a gas port at the first level for supplying fuel to the first subset of the slave injectors, and a second gas port at the second level for supplying fuel to the second subset of the slave injectors: The manifold includes a manifold divider'plate mounted to the radially inner and outer walls and to the slave injectors, with the manifold divider plate spaced between the upper and lower manifold plates axially between the first and second levels to divide flow within the manifold to the first and second subsets of the slave injectors. It is contemplated that a pair of opposed partition plates can be mounted to a cylindrical portion of the manifold housing the master injector for dividing a first flow passage defined from a first inlet to the first subset of the slave injectors from a second flow passage defined from a second inlet to the second subset of the slave injectors.

In accordance with certain embodiments, the master injector includes separate inlets for at least two different fuels, such as at least one LCV fuel gas and at least one other fuel gas, such as natural gas. The pressure vessel can include a pressure dome with a central aperture and a central inlet fitting mounted to the central aperture of the pressure dome. The central inlet fitting is mounted to an interior rim of the central aperture of the pressure dome and to the manifold within the pressure vessel for removal of the pressure dome with the central inlet fitting and manifold remaining in place.

An outlet bulkhead can be mounted to outlets of each of the master and slave injectors. The outlet bulkhead can have an outlet opening sealed around the outlet of each injector. A floating collar can be movably mounted to each outlet opening to seal between the outlet of each respective injector and the outlet bulkhead to accommodate relative thermal expansion and contraction of the injectors and outlet bulkhead. Each floating collar can be partially sandwiched between an upper plate of the outlet bulkhead and a lower plate of the outlet bulkhead that is mounted to the upper plate of the outlet bulkhead. The manifold can be mounted to the outlet bulkhead by a plurality of springs for accommodating relative thermal expansion and contraction between the manifold and outlet bulkhead.

In certain embodiments, the master injector includes a diverging outlet having a plurality of swirl holes defined therethrough for introducing an auxiliary swirling flow of cooling air into the diverging outlet. The master injector can also house the igniter, allowing easy access and removal for the igniter.

In is contemplated that the master injector can include a fuel inlet fixture configured and adapted to selectively supply at least two different types of fuel in a proportional mix to the master injector. The slave injectors can be configured and adapted to selectively inject at least natural gas and LCV fuel gas in a proportional mix, for example.

The invention also provides a method of operating a combustion system for an LCV fuel gas turbine engine. The method includes introducing a starter fuel, such as natural gas, into a combustor through a Master injector and igniting the starter fuel to initiate combustion. Starter fuel is introduced through a plurality of slave injectors. The combusting starter fuel from the master injector ignites the starter fuel from the slave injectors. LCV fuel injection is initiated by proportionally reducing starter fuel flow and increasing LCV fuel flow to the slave injectors until the slave injectors inject only LCV fuel. The method also includes switching gas flow through the master injector from starter fuel to LCV fuel to run the combustion system exclusively on LCV fuel.

The invention further provides a method of operating a combustion system for an LCV fuel gas turbine engine. The method includes injecting LCV fuel through a plurality of slave injectors of a combustion system as described above. The method also includes reducing overall engine power by reducing flow to only some of the master and slave injectors to maintain relatively hot downstream local flame temperatures for stable combustion.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein:

FIG. 7 is a cross-sectional side elevation view of the diverging outlet of the master injector of FIG. 6, showing the swirler ports;

FIG. 8 is an exploded perspective view of the manifold of FIG. 6, showing the manifold plates and side walls;

DETAILED DESCRIPTION OF THE PREFERRED EMBODIMENTS

Figure 1:
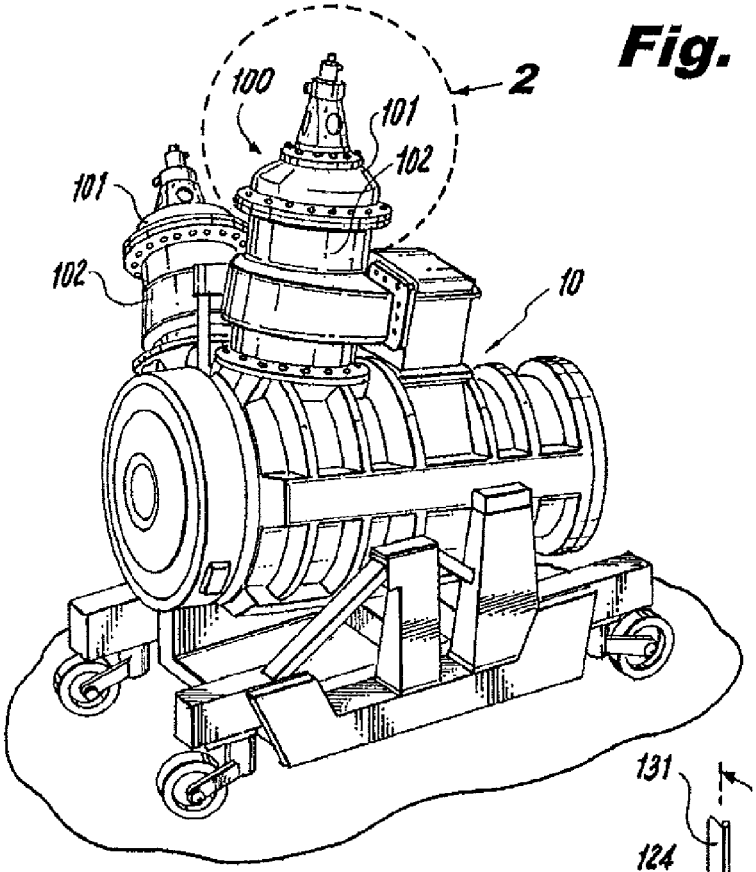
FIG. 1 is a perspective view of an exemplary embodiment of a gas turbine engine constructed in accordance with the present invention, showing a combustion system with two LCV fuel combustors mounted to the engine.

Reference will now be made to the drawings wherein like reference numerals identify similar structural features or aspects of the subject invention. For purposes of explanation and illustration, and not limitation, a partial view of an exemplary embodiment of a combustion system constructed in accordance with the invention is shown in FIG. 1 and is designated generally by reference character 100. Other embodiments of combustion systems in accordance with the invention, or aspects thereof, are provided in FIGS. 2-20, as will be described. The system of the invention can be used to improve performance of gas turbine engines operating on low calorific value (LCV) fuel.

Figure 2:
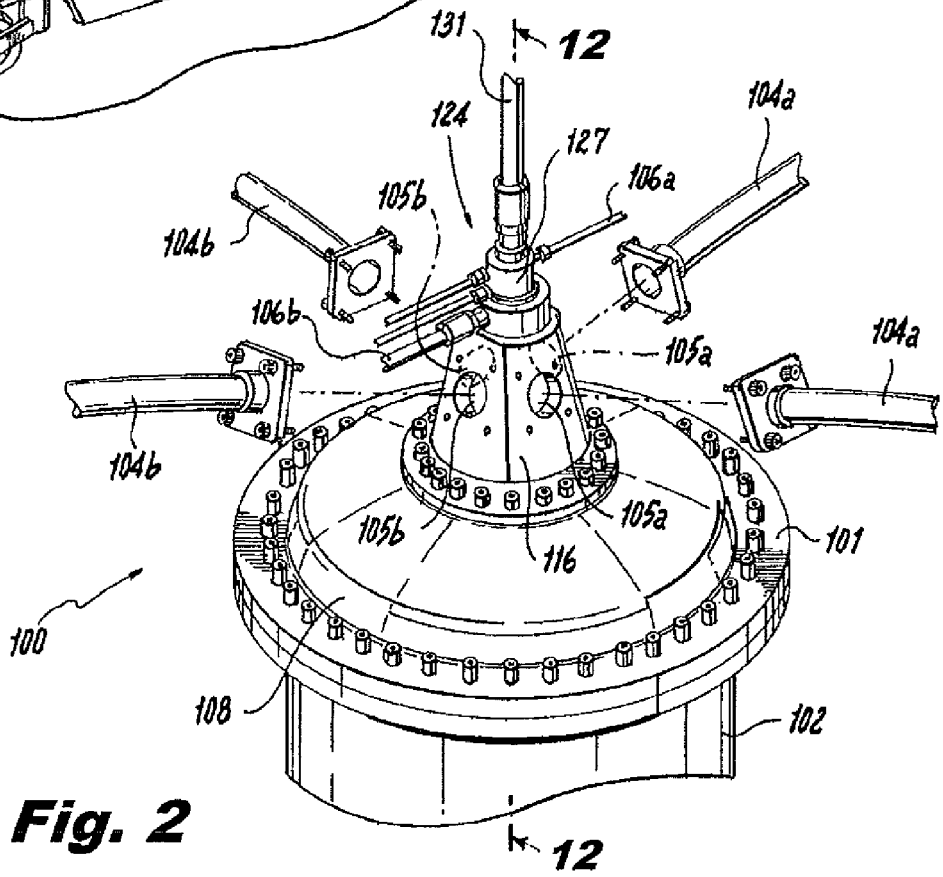
FIG. 2 is a perspective view of a portion of one of the combustors of FIG. 1, showing the pressure dome with the LCV fuel conduits removed from the inlet fittings.

With reference now to FIG. 1, a gas turbine engine 10 is shown having a combustion system 100 with two LCV fuel combustors 101. Each combustor 101 includes a housing 102 defining a pressure vessel for providing combustion products at high pressure to be supplied to the turbine of engine 10. Pressurized fuel is supplied to combustor 101 through inlet conduits 104*a*, 104*b*, 106*a*, and 106*b* that are connected to inlet fitting 116, as indicated in FIG. 2. Each of two inlet conduits 104*a* (only one of which is shown in FIG. 2) is connected to a respective port 105*a* of inlet fitting 116, and each of two inlet conduits 104*b* (only one of which shown in FIG. 2) is connected to a respective port 105*b*. There are two ports 105*a*, and two ports 105*b*, which form high pressure flanges permitting a high volume flow of specified gasses through each opening, with enough flow capacity for LCV fuel operation, for example. One or more of these ports 105*a* and 105*b* for high pressure flows can be staged, e.g., reduced or shut off, during engine operation, as described in greater detail below. Ports 105*a* and 105*b* can be of any suitable size to accommodate the high volume needed for LCV gas operation, for example, each port 105*a* and 105*b* can be about three inches in diameter. Those skilled in the art will readily appreciate that any suitable number of ports 105*a* and 105*b* and inlet conduits 104*a* and 104*b* can be used without departing from the spirit and scope of the invention.

Figure 3:
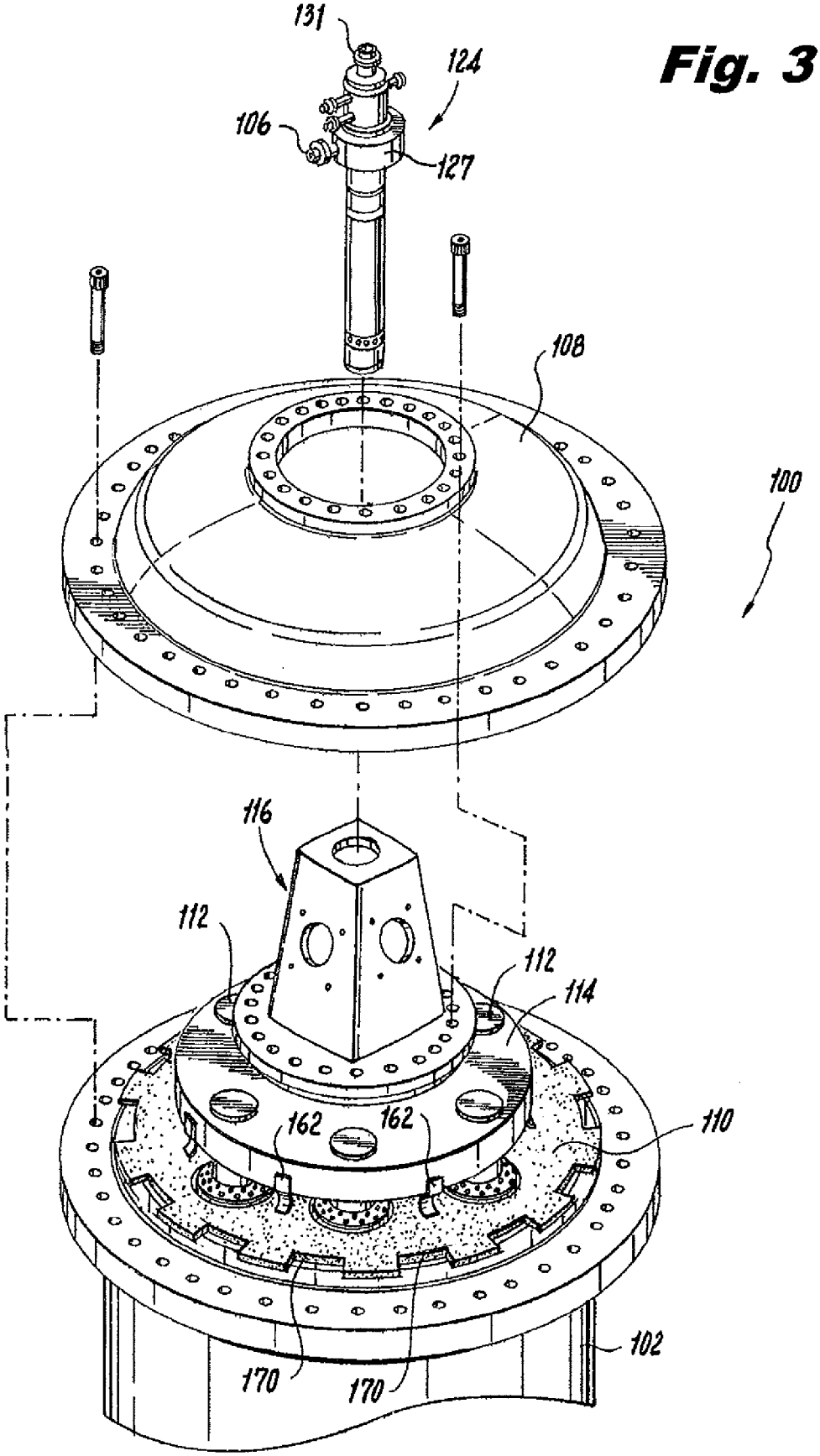
FIG. 3 is a perspective view of a portion of the combustor of FIG. 2, showing the pressure dome removed with the LCV fuel manifold and injectors mounted to the combustor.

The pressure vessel of housing 102 includes a pressure dome 108 which can be removed, as indicated in FIG. 3, to access bulkhead 110, slave injectors 112, and manifold 114 without having to remove inlet fitting 116. Central inlet fitting 116 is mounted to an interior rim of the central aperture of pressure dome 108, as shown in FIG. 12. This arrangement allows the flange of inlet fitting 116 to have self-sealing against the corresponding flange of pressure dome 108. Therefore, the greater the pressure in pressure dome 108, the tighter the seal and the lighter the flange construction can be. By contrast, if such a joint were instead in tension, more bolts and a heavier flange would be required to prevent warping and leaking.

Figure 4:
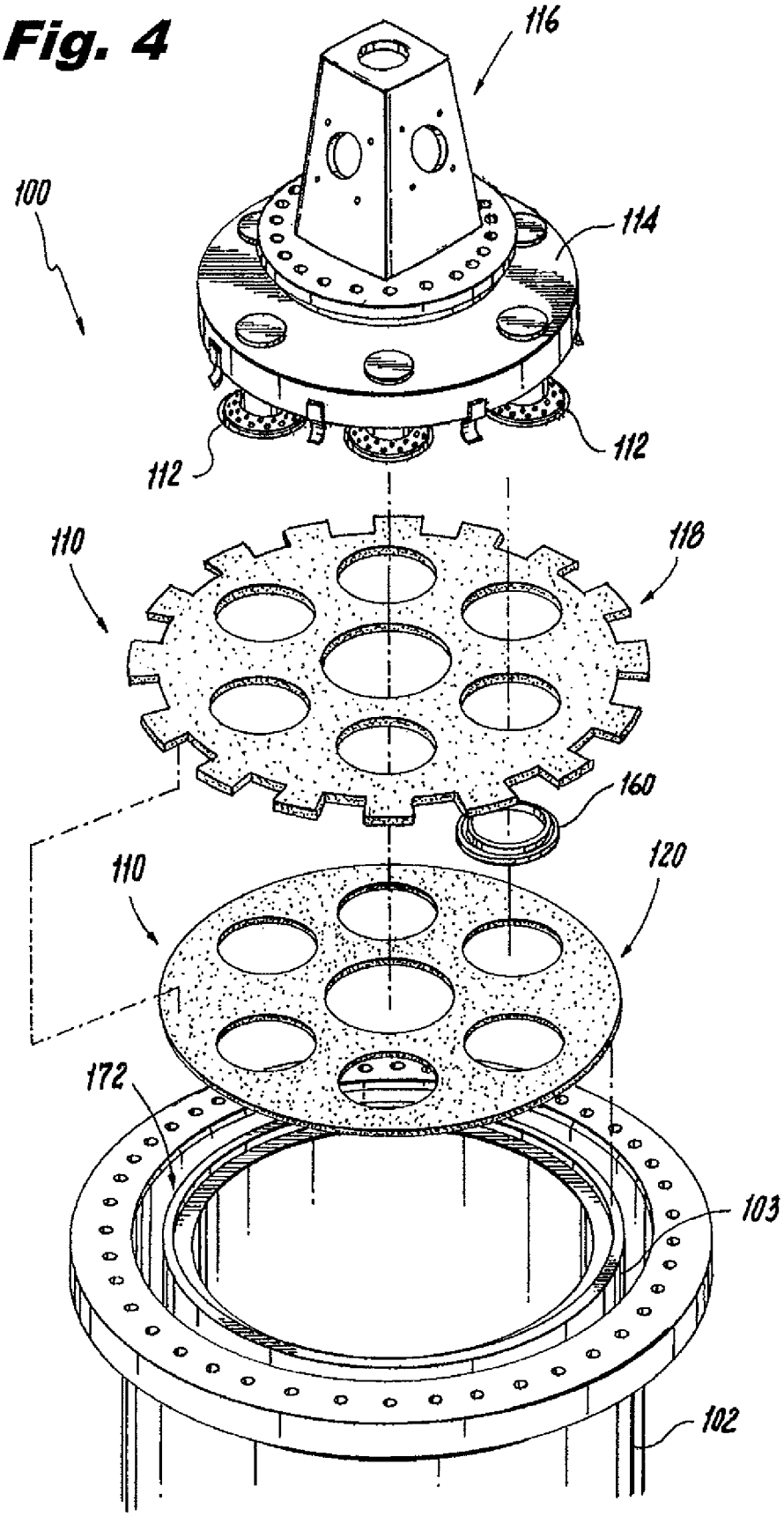
FIG. 4 is an exploded perspective view of a portion of the combustor of FIG. 3, showing the injectors separated from the upper and lower plates of the combustor bulkhead.
Figure 5:
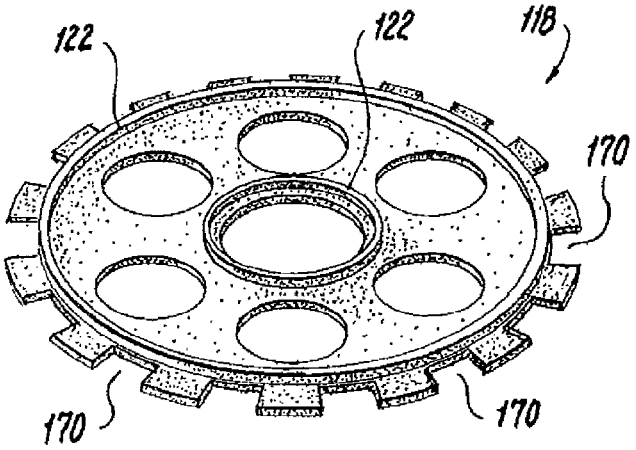
FIG. 5 is a perspective view of the upper bulkhead plate of FIG. 4, showing the bulkhead plate from below to reveal the standoffs for maintaining separation between the upper and lower bulkhead plates.

Referring now to FIG. 4, bulkhead 110 includes an upper plate 118 and lower plate 120 which have openings therethrough to accommodate the outlets of slave injectors 112 to allow for thermal expansion and contraction, as will be described in greater detail below. The edges of plates 118 and 120 are trapped by housing 102 and inner combustor wall 103 with radial clearance to allow radial expansion and contraction to accommodate thermal growth mismatches. Separation of upper and lower plates 118 and 120 is maintained by standoffs 122, which are not visible in FIG. 4, but are shown in FIG. 5, which shows the underside of upper plate 118. Bulkhead 110 can be cooled by backside impingement with air flow through offset holes (not shown) in upper plate 118 and lower plate 120 as needed from application to application.

Figure 6:
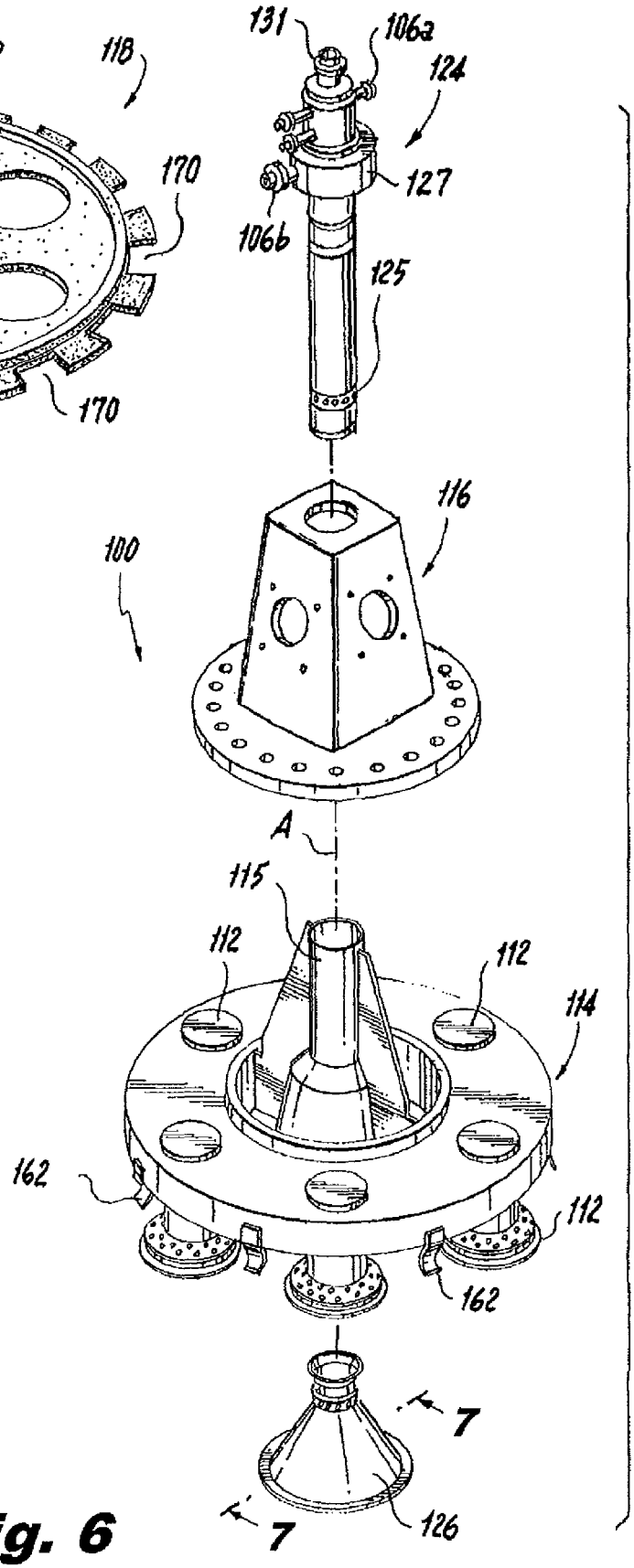
FIG. 6 is an exploded perspective view of a portion of the combustor of FIG. 4, showing the inlet fitting separated from the manifold, and showing the diverging outlet of the master injector separated from the manifold.

Referring now to FIGS. 6 and 7, a master injector 124 is mounted to inlet fitting 116 and manifold 114 for injecting fuel along a central axis (A) defined through pressure vessel 102. Master injector 124 includes separate inlets 106*a* and 106*b* for at least two different fuels, such as at least one LCV fuel gas and at least one other fuel gas, such as natural gas. Master injector 124 includes a diverging outlet 126, which includes a plurality of radial slots 128 for injecting a swirling flow of auxiliary air for gas mixing and cooling along the downstream surfaces of master injector 124 to protect against the high temperature combustion within pressure vessel 102. Master injector 124 also includes a second plurality of swirl bores 125 defined in a cylindrical portion thereof upstream of diverging outlet 126 for providing auxiliary combustion air and for imparting swirl to the flow from master injector 124. FIG. 12*b* shows the flow of air up from the compressor through annular passage 172, through the castellation features 170 in bulkhead 110, also shown in FIG. 5, and into pressure dome 108. From here, the air can flow into combustor 101 through swirl bores 125 and radial slots 128 in master injector 124, as well as through the air passages of slave injectors 112, which will be discussed in greater detail below.

Referring again to FIGS. 6 and 7, master injector 124 and igniter 131 can be removed from inlet fitting 116 and manifold 114 independent of slave injectors 112, providing easy access for maintenance, removal, and/or replacement of igniter 131. Diverging outlet 126 remains trapped by its seal 129 between upper and lower plates 118, 120 of bulkhead 110 when master injector 124 is removed from manifold 114 because there is a sliding engagement between the cylindrical portion of master injector 124 and diverging outlet 126 to accommodate axial thermal expansion and contraction. Master injector 124 includes a fuel inlet fixture 127 configured and adapted to selectively supply at least two different types of fuel in a proportional mix to master injector 124, such as LCV fuel gas and natural gas. The slave injectors 112 are similarly configured and adapted to selectively inject at least natural gas and LCV fuel gas in a proportional mix, as described below. An igniter 131 is included in inlet fixture 127 for igniting fuel from master injector 124 during startup.

Figure 9:
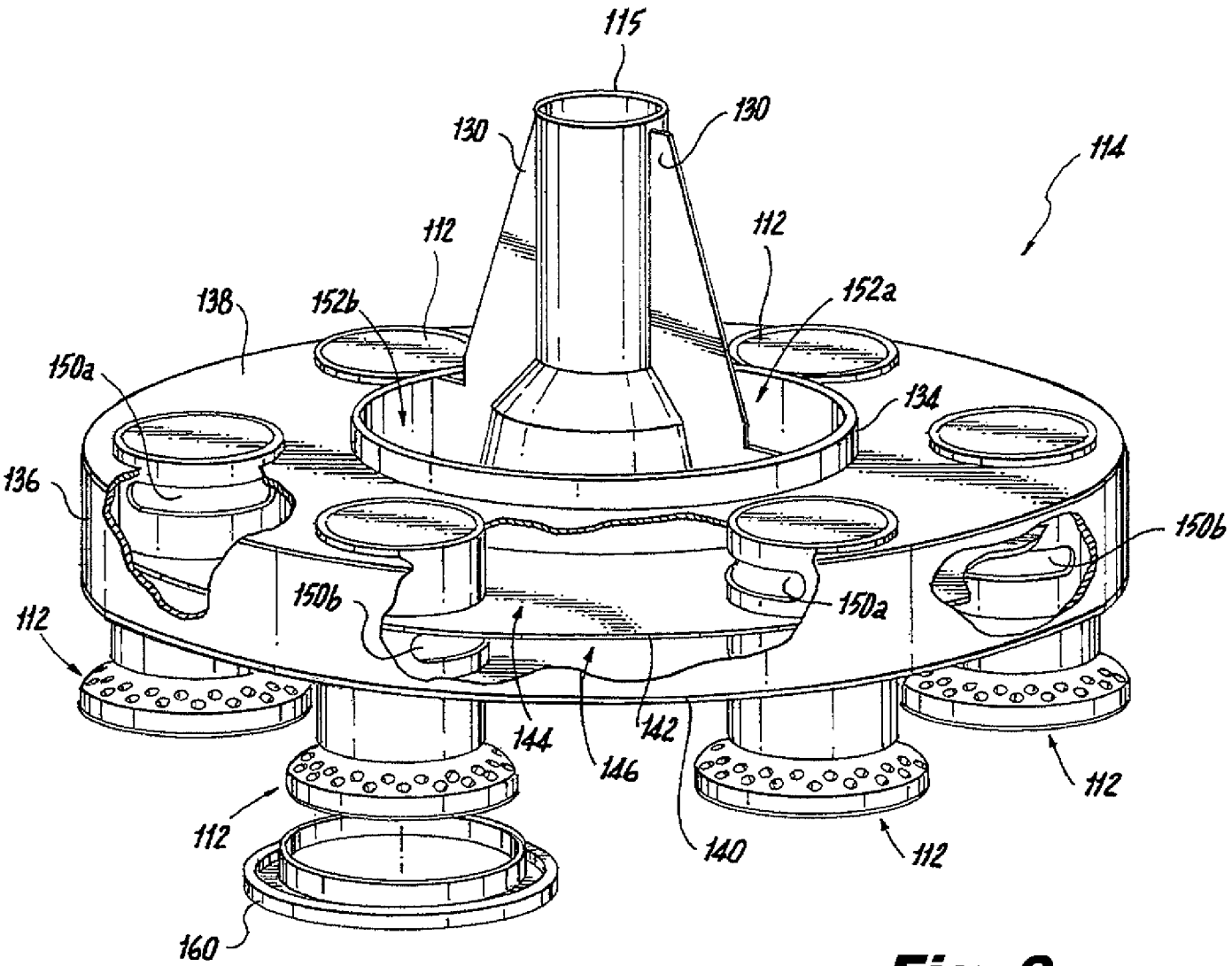
FIG. 9 is a partially cut-away perspective view of the manifold of FIG. 6, showing the slave injectors assembled into the manifold.

With reference now to FIGS. 8 and 9, manifold 114 includes partition plates 130 affixed to a cylindrical injector housing 115 of manifold 114 through which master injector 124 is housed when assembled. Partition plates 130 are also advantageously welded or otherwise jointed to inlet fitting 116 to separate flows from different inlets to different injectors as will be described in greater detail below. An inner cylindrical wall 134 is mounted to partition plates 130 and includes two pill-shaped ports 132*a* and 132*b*. Opposed, to inner cylindrical wall 134 is outer cylindrical wall 136. Upper manifold plate 138 and lower manifold plate 140 are mounted to inner and outer cylindrical walls 134, 136 to form an annular manifold space. Manifold separator plate 142 is mounted to inner and outer cylindrical walls 134, 136 at an elevation about half-way between upper and lower manifold plates 138, 140. Separator plate 142 divides the annular manifold space of manifold 114 into an upper duct 144 and a lower duct 146. Manifold plates 138, 140, and 142 each have six slave injector bores 148, shown in FIG. 8, for accommodating slave injectors 112 as shown in FIG. 9. With slave injectors 112 mounted in bores 148, slave injectors 112 stiffen manifold 114, and the arrangement of slave injectors 112 around a central master injector 124 provides a compact multi-stage gas inlet fitting for system 100.

With continued reference to FIG. 9, each slave injector has a single pill-shaped inlet perforation or port 150*a* or 150*b*. Ports 150*a* are in fluid communication with upper duct 144 of the annular manifold space, which is in fluid communication with port 132*a* (shown in FIG. 8) of inner cylindrical wall 134. Ports 150*b* are in fluid communication with lower duct 146 of the annular manifold space, which is in fluid communication with port 132*b* (shown in FIG. 8) of inner cylindrical wall 134. Ports 132*a* and 132*b* (Shown in FIG. 8) of inner cylindrical wall 134 are on opposite sides of partition plates 130, which divide the space between cylindrical injector housing 115 and inlet fitting 116 into two manifold spaces 152*a* and 152*b* in fluid communication with ports 132*a* and 132*b*, respectively.

Inlet ports 150*a* are at a different, axially spaced apart level from the level of inlet ports 150*b*. As oriented in FIG. 9, inlet ports 150*a* are at a higher level in fluid communication with upper duct 144 of the annular manifold space, and inlet ports 150*b* are at a lower level in fluid communication with lower duct 146 of the annular manifold space. Three of the injectors have inlet ports 150*a*, and the other three slave injectors 112 have inlet ports 150*b*. Therefore, each slave injector 112 is in fluid communication with only one of upper and lower ducts 144, 146 of the annular manifold space.

With inlet fitting 116 in place as shown in FIG. 2, manifold 114 separates fuel flow to slave injectors 112 into two separate stages capable of being controlled externally for independent operation. This separation allows for reduced power levels, as described in greater detail below. The flow path for the first stage includes inlet conduit 104*a* (shown in FIG. 2), port 105*a* of inlet fitting 116 (shown in FIG. 6), manifold space 152*a* (shown in FIG. 9), port 132*a* in inner cylindrical wall 134 (shown in FIG. 8), upper duet 144 of the annular manifold space in manifold 114, pill-shaped ports 150*a* in first stage slave injectors 112, and through the outlets of the three first stage slave injectors 112. The flow path for the second stage includes inlet conduit 104*b* (shown in FIG. 2), port 105*b* of inlet fitting 116 (shown in FIG. 6), manifold space 152*b* (shown in FIG. 9), port 132*b* in inner cylindrical wall 134 (shown in FIG. 9), lower duct 146 of the annular manifold space in manifold 114, pill-shaped ports 150*b* in first stage slave injectors 112, and through the outlets of the three second stage slave injectors 112. Manifold 114 is configured to separately distribute fuel to two subsets of the slave injectors. The slave injectors 112 of each stage can selectively inject natural gas and LCV fuel gas in a proportional mix, much like master injector 124. The entire manifold assembly is installed within pressure vessel 102, reducing pressure and temperature gradients between manifold 114 and the external environment.

Those skilled in the art will readily appreciate that the configuration described herein with three slave injectors in each of two stages is exemplary only. Any suitable number of injectors can be used in any suitable number of stages, including configurations where each stage has a different number of injectors, without departing from the spirit and scope of the invention.

Figure 10:
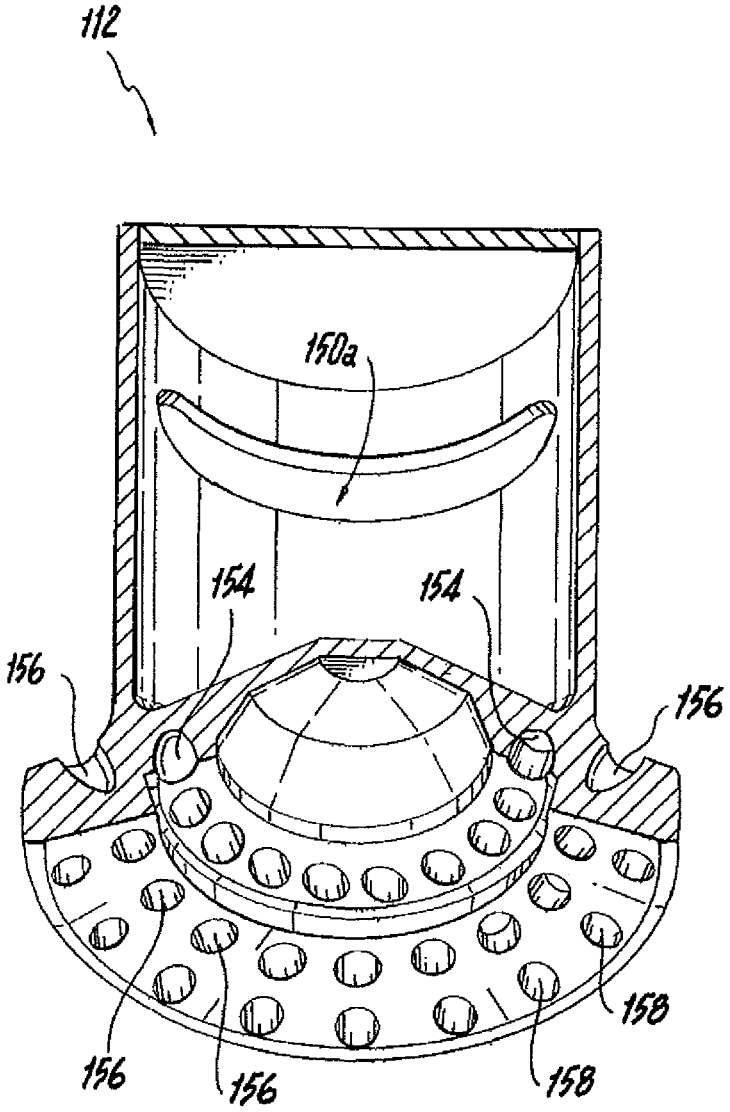
FIG. 10 is a cross-sectional perspective view of one of the slave injectors of FIG. 9.
Figure 11A:
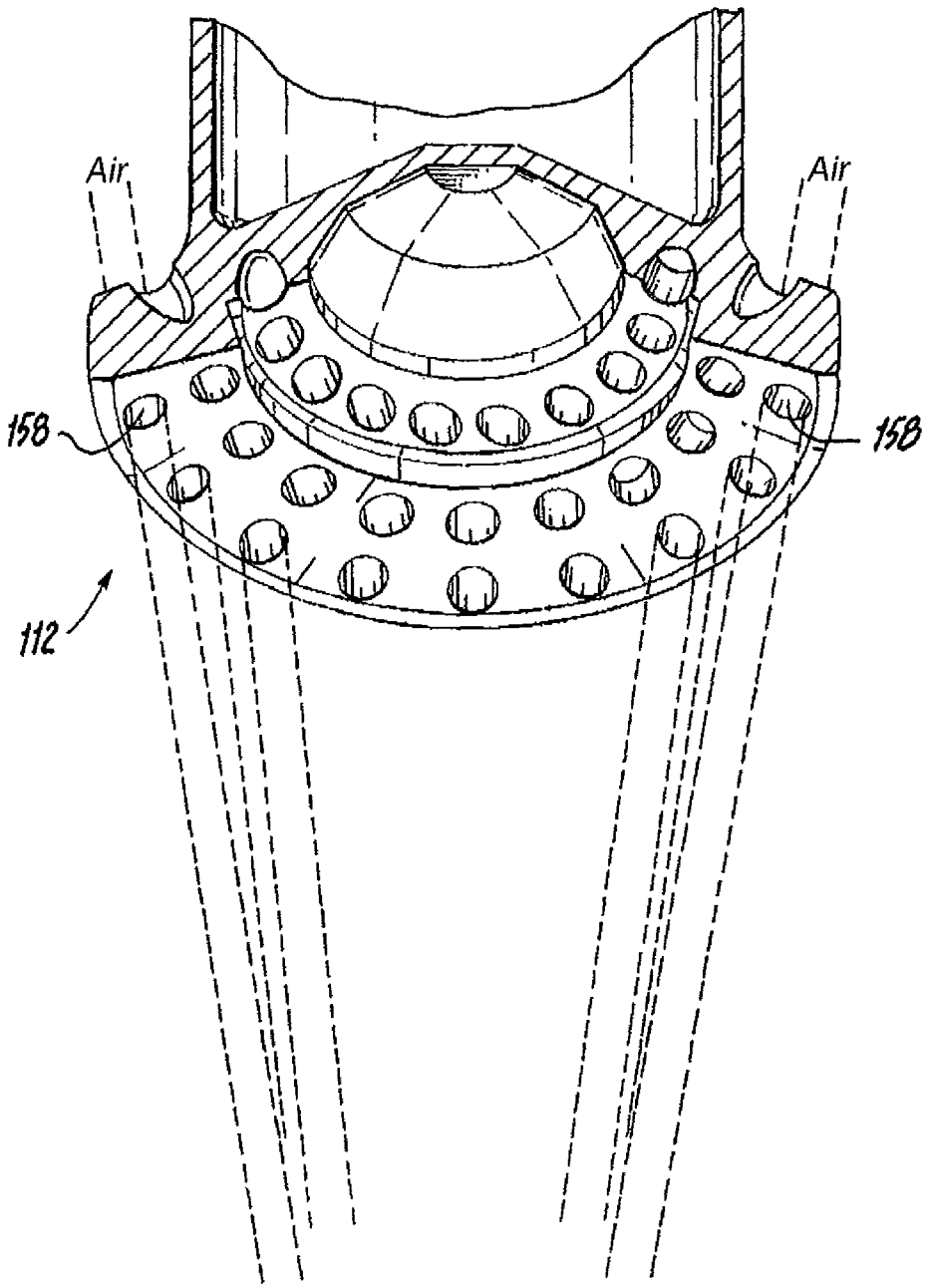
FIG. 11*a* is a cross-sectional perspective view of a portion of the slave injector of FIG. 10, showing the orientations of the converging outer air ports.
Figure 11B:
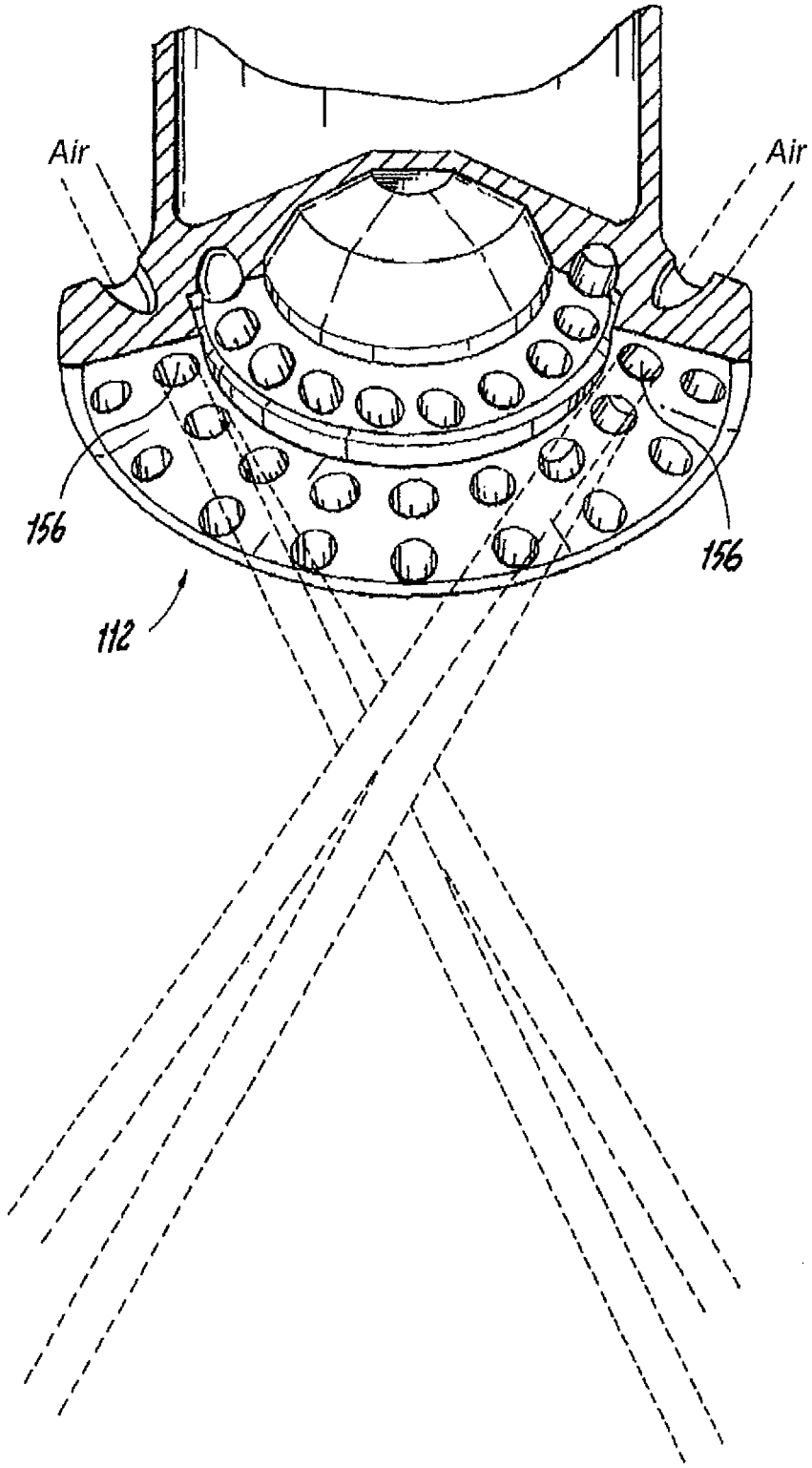
FIG. 11*b* is a cross-sectional perspective view of a portion of the slave injector of FIG. 10, showing the orientations of the converging, swirling inner air ports.
Figure 11C:
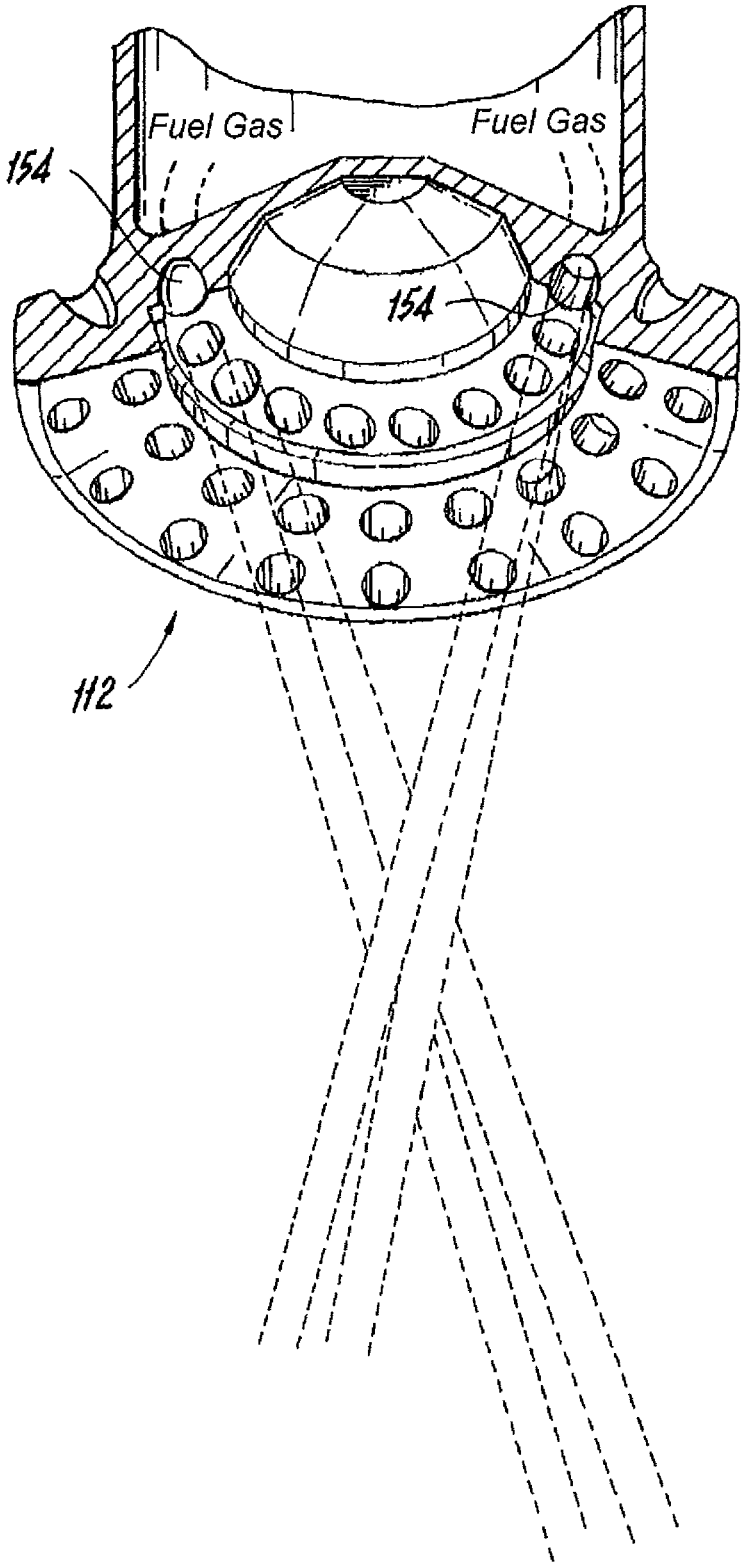
FIG. 11*c* is a cross-sectional perspective view of a portion of the slave injector of FIG. 10, showing the orientations of the converging, swirling fuel ports.

Referring now to FIG. 10, each slave injector 112 includes three sets of injection ports. The innermost set of injection ports 154 inject fuel from port 150*a* (or 150*b* if applicable) for combustion. Intermediate injection ports 156 and outer injection ports 158 inject air from within pressure dome 108 (see FIG. 12*b*). As shown in FIG. 11*a*, outer injection ports 158 are aligned to inject a converging, non-swirling flow of air, which converges into the flows of air and gas from ports 154 and 156. As shown in FIG. 11*b*, intermediate injection ports 156 are aligned to inject a converging, swirling flow of air, which intersects the converging, swirling flow from injection ports 154, which is indicated in FIG. 11*c*. In this manner, the fuel is given a high, divergent swirl. Inner air jets are given convergent swirl to mix with fuel close to injector 112 in a rich burn fashion. The outer swirl, i.e., from ports 158, is less convergent, but confines the flow and provides lean burn out action. Those skilled in the art will readily appreciate that any other suitable flow port configuration can be used from application to application.

Figure 12A:
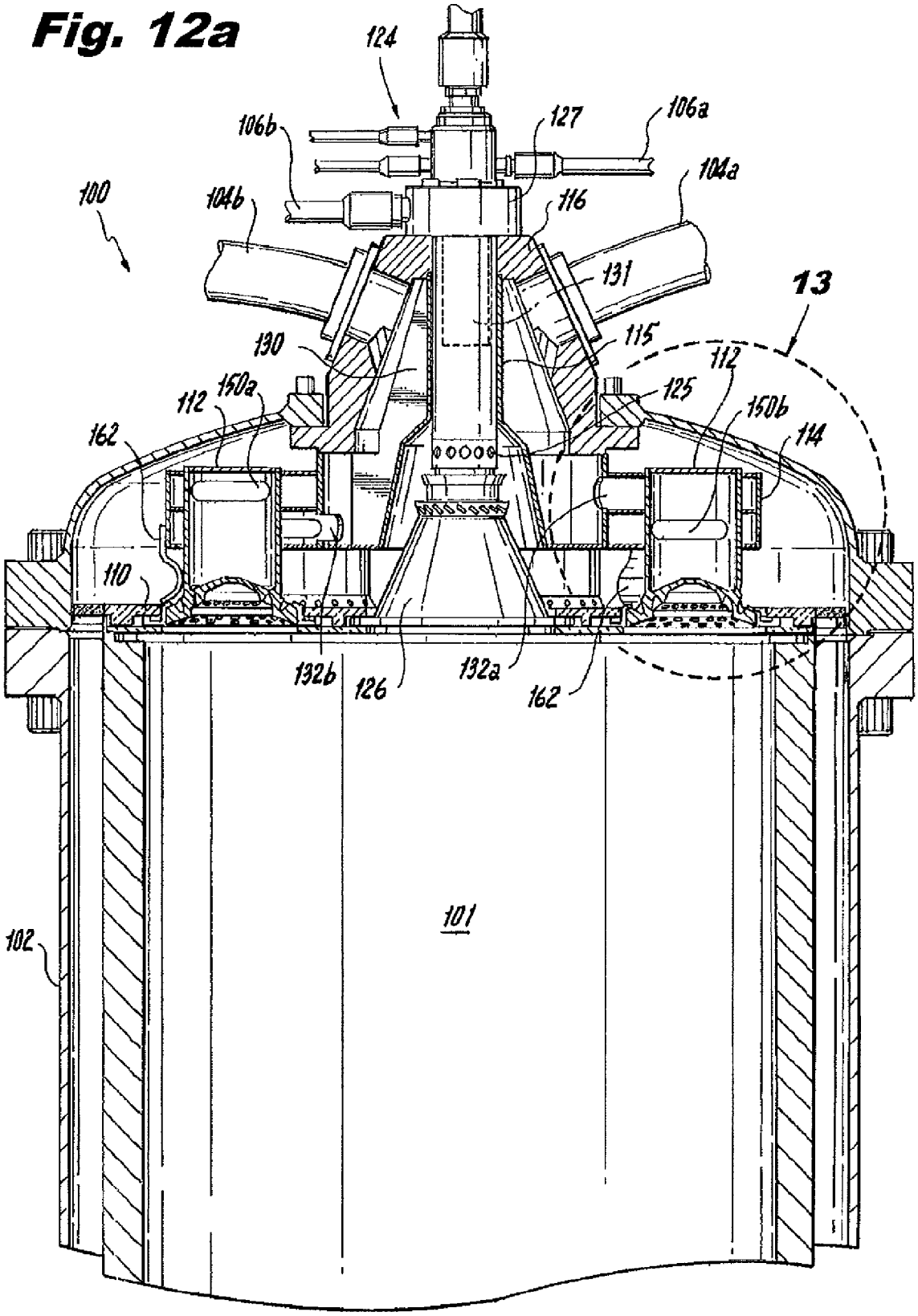
FIG. 12*a* is a cross-sectional side elevation view of the combustor of FIG. 2, showing manifold, injectors, igniter, inlet fitting, bulkhead, and pressure dome assembled together.
Figure 12B:
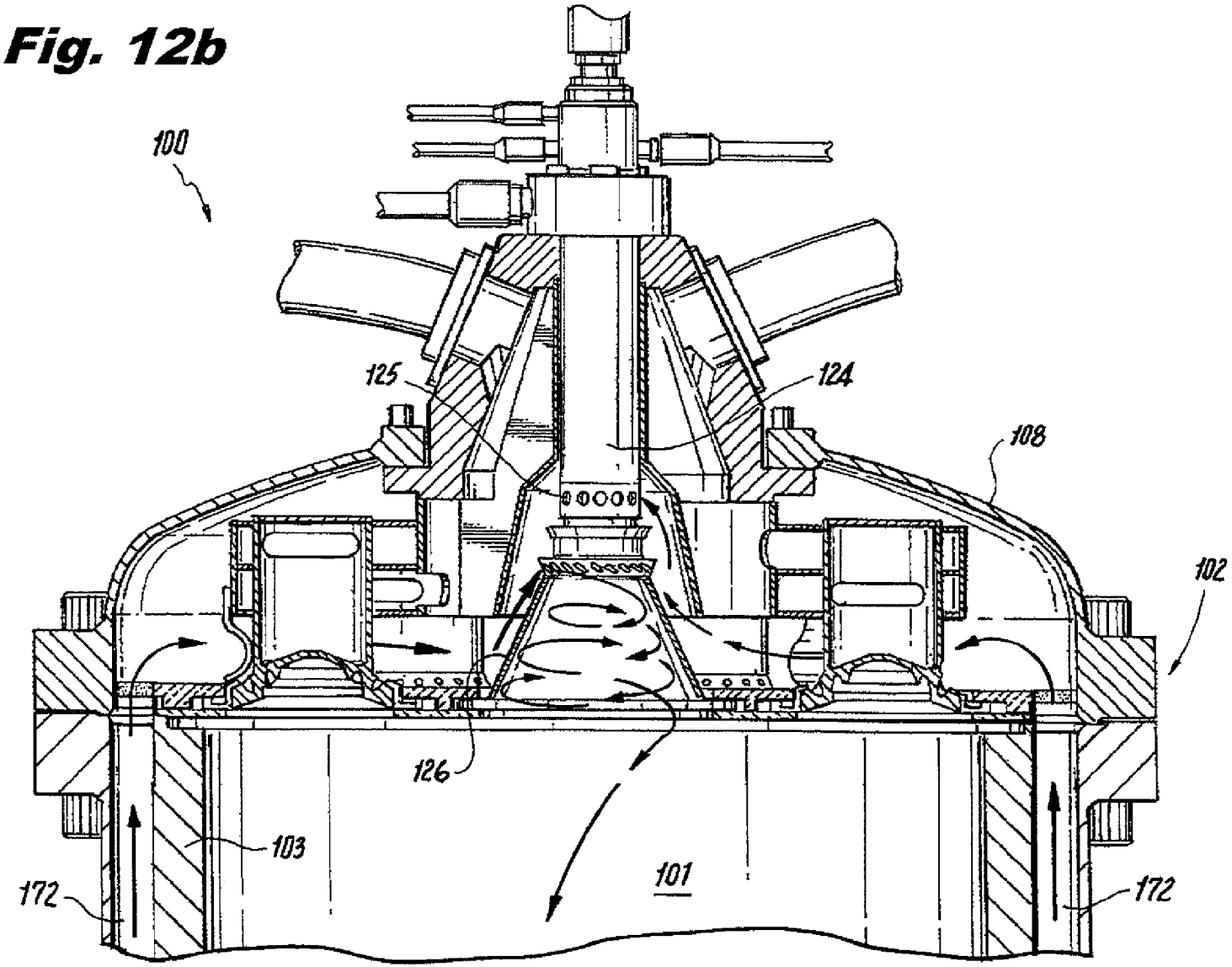
FIG. 12*b* is a cross-sectional side elevation view of a portion of the combustor of FIG. 12*a*, showing the flow of compressor discharge air into the pressure dome and out the master injector.
Figure 13:
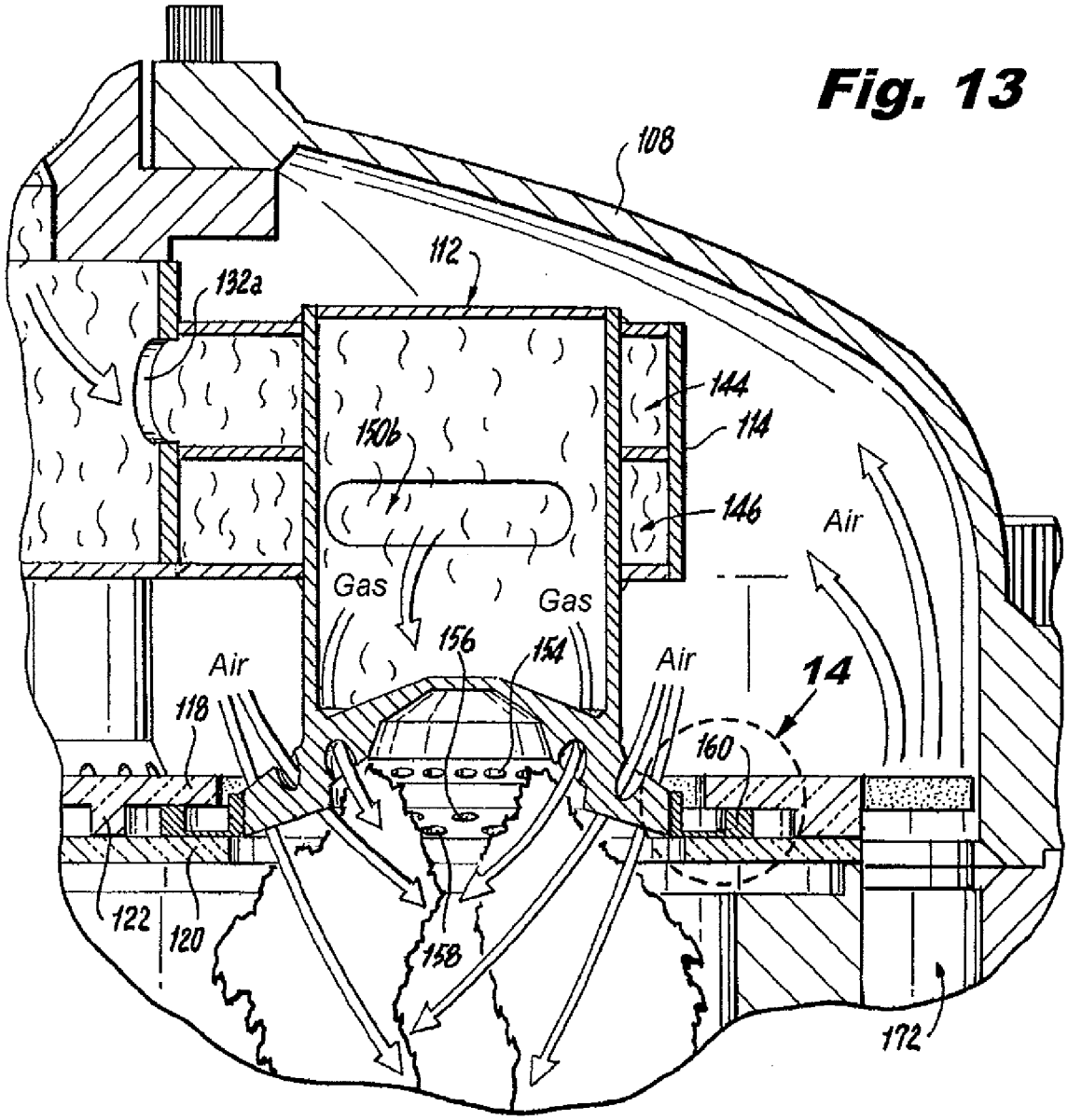
FIG. 13 is a cross-sectional side elevation view of the portion of the combustor indicated in FIG. 12, showing the flow of fuel and air through one of the slave injectors and showing the moveable engagement of one of the slave injectors to the combustor bulkhead.
Figure 14:
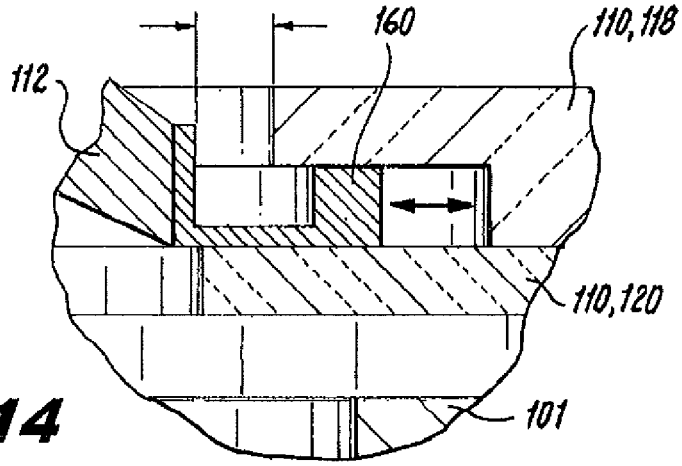
FIG. 14 is a cross-sectional side-elevation view of the portion of the combustor bulkhead indicated in FIG. 13, showing the moveable seal sealing around the slave injector between the upper and lower plates of the bulkhead.

With reference now to FIG. 12*a*, each slave injector 112 is disposed radially outward of and substantially parallel to master injector 124. Master injector 124 is shown solid, rather than in cross-section in FIG. 12*a*, with igniter 131 indicated in hidden lines. FIG. 13 shows an enlargement of the area indicated in FIG. 12, to show the flow of air and gas through the injection ports 154, 156, and 158 for combustion, as indicated by the arrows and combustion lines in FIG. 13. FIG. 13 also shows upper and lower plates 118, 120 of bulkhead 110 engaging seal 160 of slave injector 112. FIG. 14 shows a further enlargement of the area indicated in FIG. 13, in which the moveable engagement of seal 160 with respect to bulkhead 110 is indicated with arrows. Seal 160 is sandwiched between upper and lower plates 118, 120 of bulkhead 110, and has an axially-sliding engagement to injector 112. In this manner, when the engine cycles through different thermal states, seals 160 act as floating collars and differential thermal expansion between bulkhead 110 and injectors 112 can be thereby be accommodated without undue stress, fatigue, and the like. Additionally, each seal 160 seals the respective opening of bulkhead 110 with a slave injector 112 to maintain proper pressure across bulkhead 110. One seal 160 is shown in FIG. 9 separated from the corresponding slave injector 112. Each seal 160 can slide with respect to its slave injector 112 in the axial direction to accommodate axial thermal contraction and expansion. Diverging outlet 126 of master injector 124 includes an integrally formed collar 129 (shown in FIG. 7), which accommodates radial thermal expansion much like seals 160. Similarly, axial thermal expansion and contraction is allowed for in master injector 124 by the axial sliding engagement of the cylindrical portion of mater injector 124 with diverging outlet 126. Free axial and radial growth is allowed for every injector 112, 124, thanks to the central location of manifold 114 and the ability for the floating collars/seals to slide while sealing air flow.

With continued reference to FIG. 12*a*, manifold 114 is mounted to bulkhead 110 by a plurality of springs 162 for accommodating relative thermal expansion and contraction between manifold 114 and bulkhead 110. Springs 162 are also shown in FIGS. 3, 4, and 6. Springs 162 serve as stand offs to permit positioning of master and slave injectors 124, 112 during assembly, and prevent manifold 114 dropping too far into combustor 101 when pressure dome 108 is removed. Pressure dome 108 is sealed from inside by its attachment to inlet fitting 116, and therefore permits assembly of master and slave injectors 124 and 112 into their various openings in bulkhead 110 before closing the pressure vessel, i.e. housing 102, during assembly. Once manifold 114 is properly installed, pressure dome 108 can be placed over manifold 114 and bolted into place.

Figure 15:
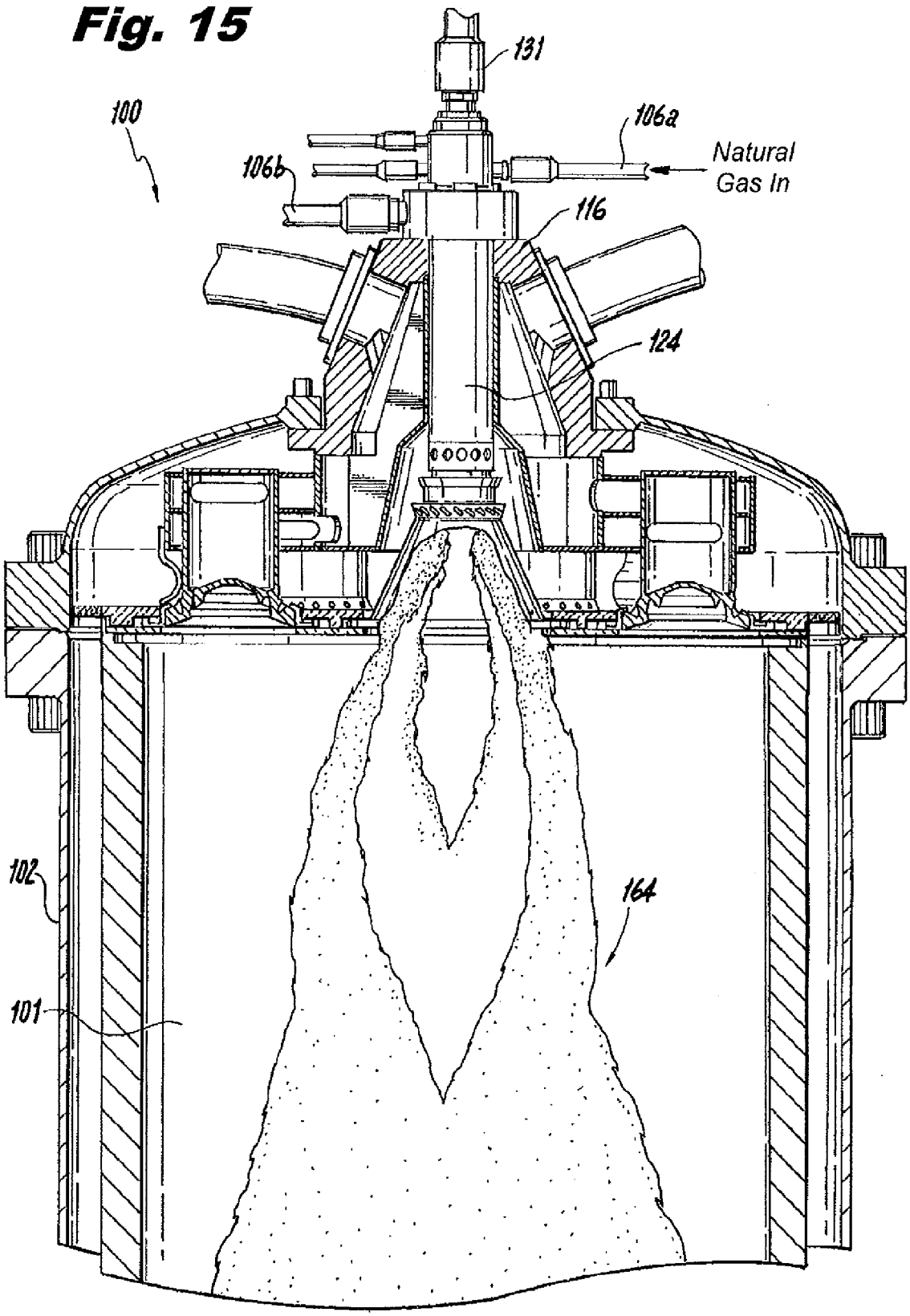
FIG. 15 is a cross-sectional side elevation view of the combustor of FIG. 12, showing natural gas from the master injector ignited along the centerline of the combustor.

With reference now to FIG. 15, the invention also provides a method of operating a combustion system, such as system 100 for an LCV fuel gas turbine engine. To initiate combustion, as during startup of the engine, natural gas is introduced into combustor 101 through inlet 106*a* of master injector 124 and ignited by igniter 131 to create a master injector plume 164 of ignited natural gas. This initial fuel flow can advantageously be in a rich fuel/air ratio, however, those skilled in the art will readily appreciate that any fuel/air ratio can be used from application to application. Igniting master injector plume 164 ignites the core area of combustor 101 and establishes a hot zone therein. The power on master injector 124 is then increased until engine idle is accomplished.

Figure 16:
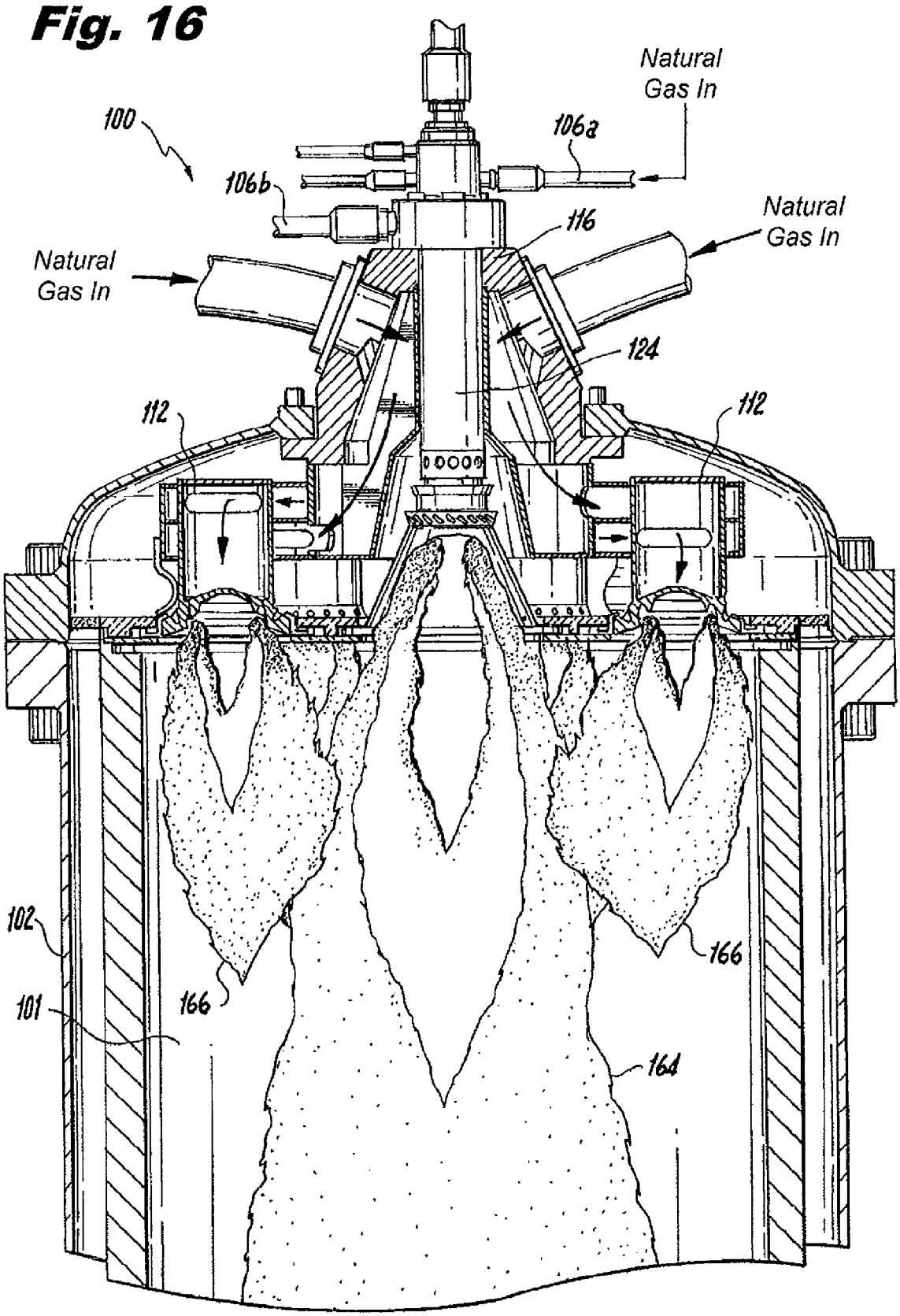
FIG. 16 is a cross-sectional side elevation view of the combustor of FIG. 15, showing natural gas from the slave injectors ignited by the combusting natural gas from the master injector along the centerline of the combustor.

Referring now to FIG. 16, natural gas is then introduced through slave injectors 112, with each slave injector forming a plume 166 of natural gas that overlaps with plume 164 of master injector 124. This brings system 100 up to full power, or other suitable high power condition. Injection plumes 166 are radially outward of fuel injected through master injector 124, and overlap or intersect with injection plume 164. Due to the intersecting of master and slave injector plumes 164 and 166, the combusting natural gas from master injector 124 ignites the natural gas from slave injectors 112. Master injector 124 is set back upstream by its diverging outlet 126 from the plane of slave injectors 112 (i.e., in bulkhead 110) to allow the flame to grow in diameter before encountering the gas from slave injectors 112, thus enabling rapid ignition and stabilization of the slave injector gasses. Master injector 124 thus acts as a pilot and as a torch. FIG. 16 indicates with arrows the flow of natural gas from inlet fitting 116 to slave injectors 112, both stages of which are shown in active operation.

Figure 17:
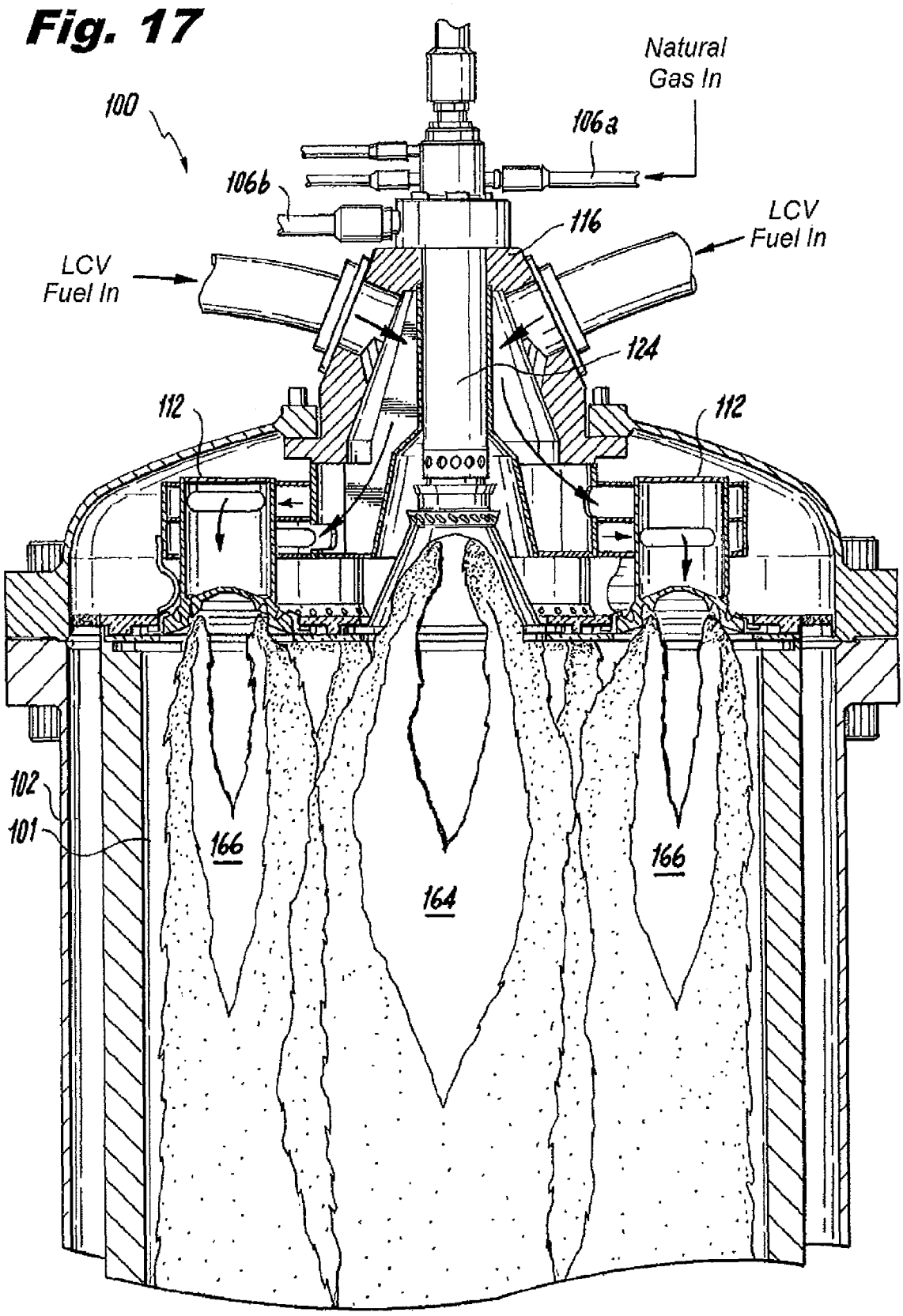
FIG. 17 is a cross-sectional side elevation view of the combustor of FIG. 16, showing LCV fuel from the slave injectors combusting with natural gas from the master injector.
Figure 18:
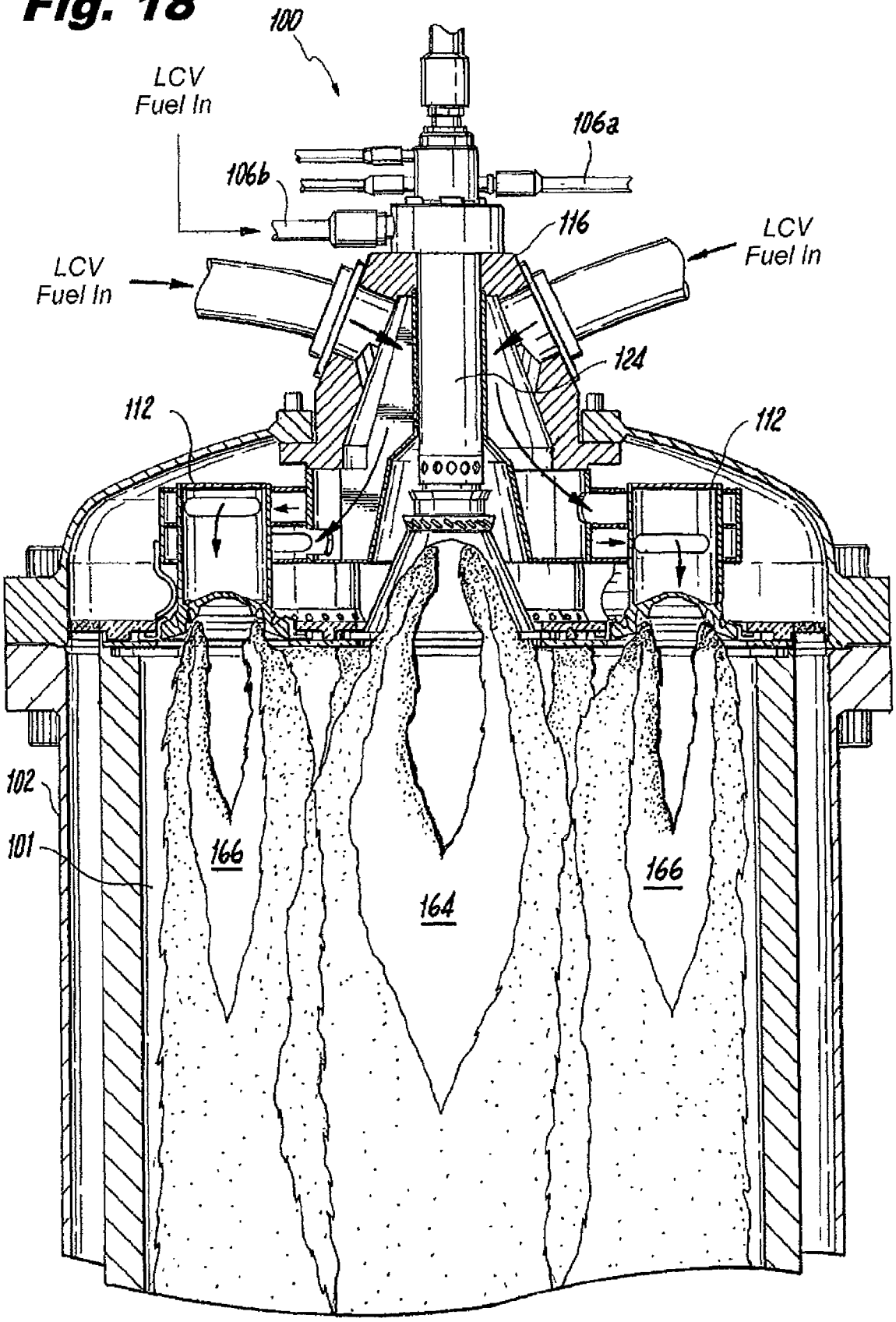
FIG. 18 is a cross-sectional side elevation view of the combustor of FIG. 17, showing all of the injectors operating with LCV fuel.

Referring now to FIG. 17, LCV fuel injection is initiated by proportionally reducing natural gas flow and increasing LCV fuel flow to slave injectors 112 until the engine reaches equilibrium on LCV fuel. This can be accomplished for all slave injectors 112 together, or in separate stages. Gas flow through master injector 124 is then switched from natural gas from inlet 106*a* to LCV fuel from inlet 106*b*, as shown in FIG. 18, to run combustion system 100 exclusively on LCV fuel. This switch to LCV fuel in master injector 124 is proportional, as described above for slave injectors 112, however, the switch could also be instant without departing from the spirit and scope of the invention. As shown in FIG. 18, natural gas and LCV fuel have separate inlets 106*a* and 106*b*, however a single inlet could be used for both types of fuel. FIG. 17 shows that system 100 can operate on multiple different fuels simultaneously. While natural gas and LCV fuel are shown, those skilled in the art will readily appreciate that these are exemplary only, and that any suitable fuels or number of fuels can be used without departing from the spirit and scope of the invention.

Figure 19:
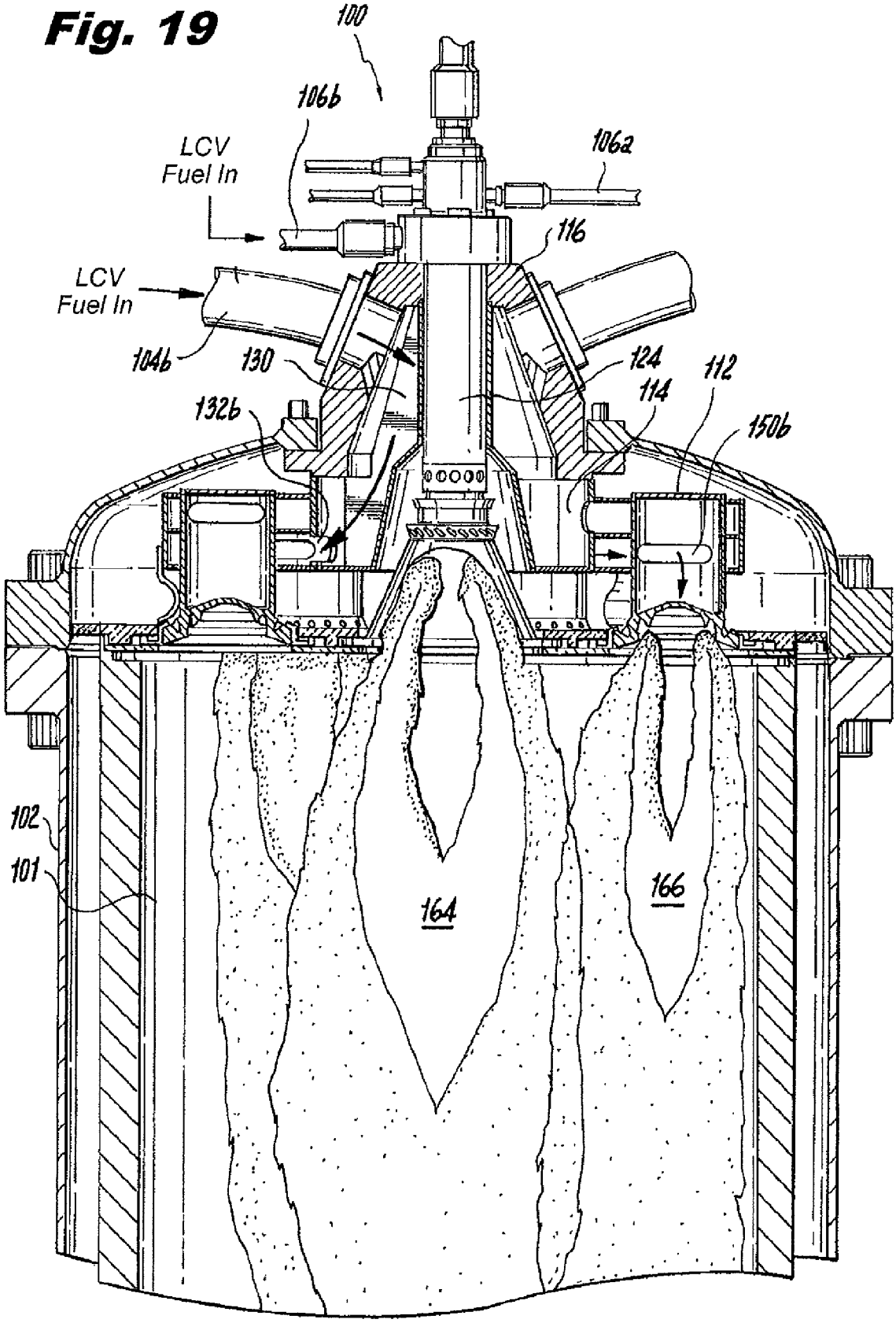
FIG. 19 is a cross-sectional side elevation view of the combustor of FIG. 18, showing some of the slave injectors in a no-flow condition such as when operating at reduced power.
Figure 20:
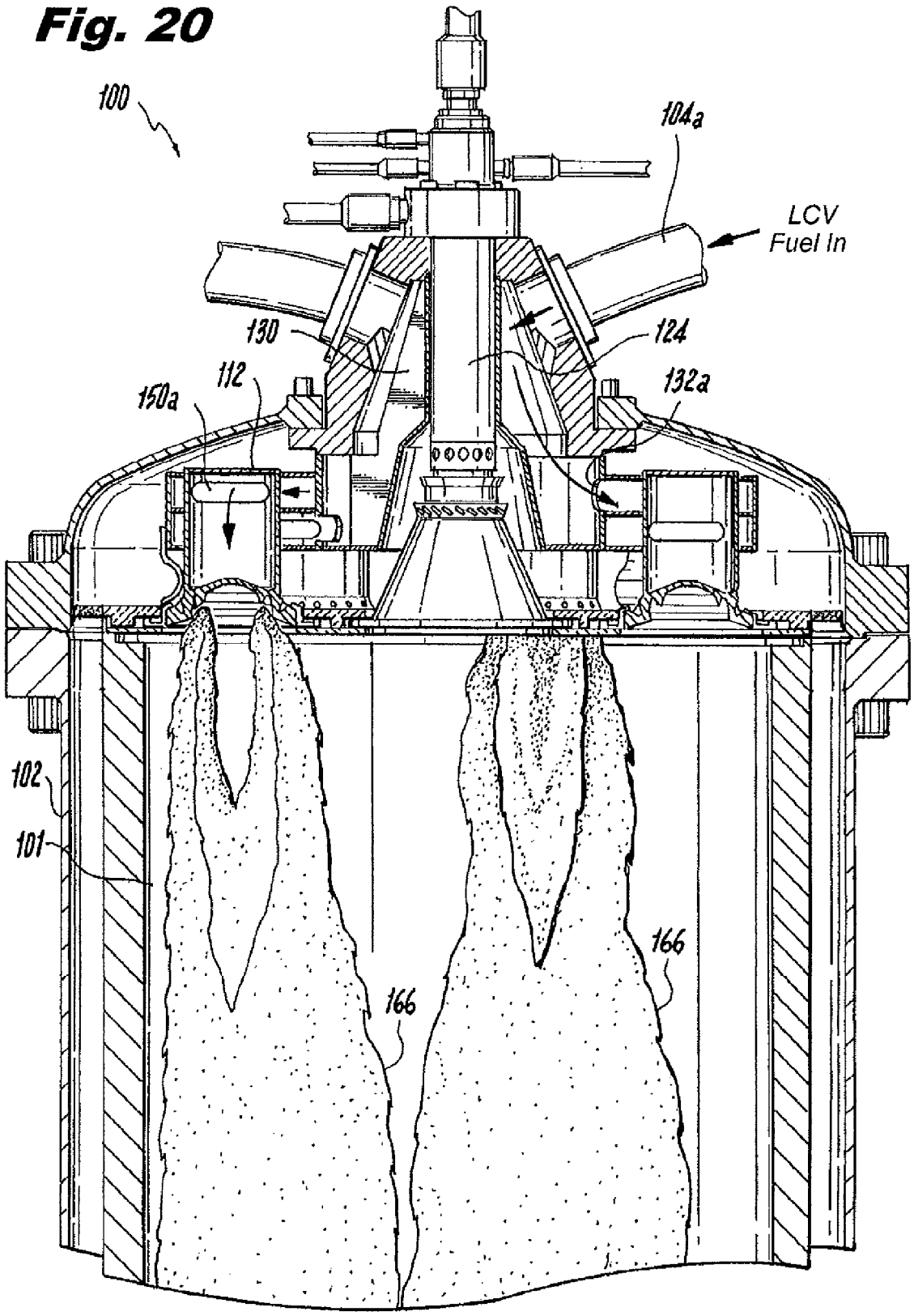
FIG. 20 is a cross-sectional side elevation view of the combustor of FIG. 19, showing reduced power operation with the master injector and some of the slave injectors in a no-flow condition.

Referring now to FIG. 19, the separate stages of slave injectors 112 can be operated independently to provide stable reduced power capability when operating on LCV fuel. Overall engine power can be reduced by reducing or even eliminating fuel flow to only some of the master and slave injectors 124 and 112 to maintain relatively hot downstream local flame temperatures for stable combustion. The fuel to air ratio on the operational stage should be kept as high as required for stable operation. Natural gas can be added to the LCV gas if required to maintain stability. In FIG. 19, master injector 124 is shown operating on LCV fuel with first stage slave injectors 112 shut off, but with second stage slave injectors 112 active. The path of fuel through the first stage in manifold 114 is indicated in FIG. 19 by arrows. In FIG. 20, another even lower power setting is shown in which flow to master injector 124 is completely shut off, but one stage of slave injectors 112 operational. Rather than reducing flow on all injectors, reducing flow on only one stage allows the flame to remain hot downstream of the operating injectors, reducing the risk of flame out that could occur if the flame were allowed to get too cool globally.

In FIG. 20, the second stage of slave injectors is shut off, and the arrows indicate the flow of fuel through the first stage of manifold 114. Those skilled in the art will readily appreciate that either stage of slave injectors could be used at either of the power levels shown in FIGS. 19 and 20 without departing from the spirit and scope of the invention. Moreover, while FIGS. 19 and 20 show the staged down injectors 112 and 124 completely shut off, those skilled in the art will readily appreciate that intermediate power settings can be accomplished with reduced flow, i.e., not completely shut off, in the injectors being staged down. As indicated by the flames shown in FIG. 20, the slave flame pattern is advantageously selected to be narrow and off the combustor walls. Those skilled in the art will readily appreciate that any suitable slave flame pattern can be used from a given application.

While master and slave injectors 124 and 112 have been described as injecting gaseous fuels, those skilled in the art will readily appreciate that liquid fuels can also be used without departing from the spirit and scope of the invention. For example, atomizers could be included in any of the master and slave injectors to allow for liquid fuel use. One exemplary application for this would be where it is desirable to use liquid fuel rather than natural gas for start up. Moreover, those skilled in the art will readily appreciate that any suitable fuels besides natural gas and LCV fuel can be used without departing from the spirit and scope of the invention.

Those skilled in the art will readily appreciate that a six-slave injector configuration is exemplary only, and that any suitable number of master and slave injectors can be used without departing from the spirit and scope of the invention. For example, the same basic method of construction could be sued in multi-staged configurations of 60 smaller slave injectors, 600 even smaller slave injectors, or any suitable number or size of slave injectors. While described herein with the exemplary single pill-shaped port or perforation for each port 132*a*, 132*b*, 150*a* and 150*b*, those skilled in the art will readily appreciate that any suitable shape or number of ports can be used on the respective injector and manifold components. The exemplary system 100 described above includes two combustors 101, however, any suitable number of combustors can be used. Additionally, while described herein in the exemplary context of two manifold stages, additional levels for ports 132*a*, 132*b*, 150*a*, and 150*b*, and additional separator plates (e.g. plates 142, 130) can be added for any suitable number of additional stages without departing from the spirit and scope of the invention. More than two subsets or stages of slave injectors can be useful in applications where greater staging or greater numbers of different fuels are used, for example. Moreover, single stage configurations in which there is only one subset or stage of slave injectors can be useful, for example, in applications delivering large amounts of fuel uniformly to multiple nozzles.

The methods and systems of the present invention, as described above and shown in the drawings, provide for low calorific value fuel combustion systems with superior properties including improved assembly, improved engine start up, and improved stability in reduced power operation compared to traditional systems. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. A combustion system for a gas turbine engine, comprising:

a) a housing defining a pressure vessel;

b) a master injector mounted to the housing for injecting fuel along a central axis defined through the pressure vessel;

c) a plurality of slave injectors each disposed radially outward of and substantially parallel to the master injector for injecting fuel and air in an injection plume radially outward of fuel injected through the master injector, wherein the master injector and slave injectors are configured and adapted so the injection plume of the master injector intersects with the injection plumes of the slave injectors; and d) an outlet bulkhead mounted to outlets of each of the master and slave injectors, the outlet bulkhead having an outlet opening sealed around an outlet of each injector; wherein a floating collar is movably mounted to each outlet opening to seal between the outlet of each respective injector and the outlet bulkhead to accommodate relative thermal expansion and contraction of the injectors and outlet bulkhead.

2. A combustion system as recited in claim 1, further comprising a manifold within the pressure vessel configured to separately distribute fuel to subsets of the slave injectors.

3. A combustion system as recited in claim 1, further comprising a manifold within the pressure vessel configured to separately distribute fuel to two subsets of the slave injectors.

4. A combustion system as recited in claim 1, wherein each slave injector includes an inlet port, wherein each injector in a first subset of the slave injectors includes an inlet port at a first level, and wherein each injector in a second subset of the slave injectors includes an inlet port at a second level, wherein the first and second levels are axially spaced along the central axis, and wherein a manifold is configured to separately direct flow form a first inlet in the pressure vessel into the inlet ports at the first level and from a second inlet in the pressure vessel into the inlet ports at the second level to separately distribute flow to the two subsets of the slave injectors.

5. A combustion system as recited in claim 4, wherein the manifold includes an upper manifold plate and an opposed lower manifold plate, wherein the upper and lower manifold plates are mounted to the slave injectors and are axially spaced apart from one another along the central axis, wherein the manifold includes a radially inner wall mounted to radially inner edges of the upper and lower manifold plates, and a radially outer wall mounted to radially outer edges of the upper and lower manifold plates, wherein the radially inner wall of the manifold includes a gas port at the first level for supplying fuel to the first subset of the slave injectors, and a second gas port at the second level for supplying fuel to the second subset of the slave injectors, and wherein the manifold includes a manifold divider plate mounted to the radially inner and outer walls and to the slave injectors, the manifold divider plate being spaced between the upper and lower manifold plates axially between the first and second levels to divide flow within the manifold to the first and second subsets of the slave injectors.

6. A combustion system as recited in claim 5, further comprising a pair of opposed partition plates mounted to a cylindrical portion of the manifold housing the master injector for dividing a first flow passage defined from a first inlet to the first subset of the slave injectors from a second flow passage defined from a second inlet to the second subset of the slave injectors.

7. A combustion system as recited in claim 1, wherein the master injector includes separate inlets for at least two different fuels.

8. A combustion system as recited in claim 1, wherein the master injector includes separate inlets for LCV fuel gas and for at least one other fuel gas.

9. A combustion system as recited in claim 1, wherein the pressure vessel includes a pressure dome with a central aperture and a central inlet fitting mounted to the central aperture of the pressure dome.

10. A combustion system as recited in claim 9, wherein the central inlet fitting is mounted to an interior rim of the central aperture of the pressure dome and to a manifold within the pressure vessel for removal of the pressure dome with the central inlet fitting and manifold remaining in place.

11. A combustor system as recited in claim 1, wherein each floating collar is partially sandwiched between an upper plate of the outlet bulkhead and a lower plate of the outlet bulkhead mounted to the upper plate of the outlet bulkhead.

12. A combustor system as recited in claim 1, further comprising a manifold within the pressure vessel configured to separately distribute fuel to subsets of the slave injectors, wherein the manifold is mounted to the outlet bulkhead by a plurality of springs for accommodating relative thermal expansion and contraction between the manifold and outlet bulkhead.

13. A combustion system as recited in claim 1, wherein the master injector includes a diverging outlet having a plurality of swirl holes defined therethrough for introducing a swirling flow of cooling air into the diverging outlet.

14. A combustion system as recited in claim 13, wherein the master injector includes a second plurality of swirl holes defined in a cylindrical portion of the master injector upstream of the diverging outlet for providing auxiliary combustion air and for imparting swirl.

15. A combustion system as recited in claim 1, wherein the master injector includes a fuel inlet fixture configured and adapted to selectively supply at least two different types of fuel in a proportional mix to the master injector.

16. A combustion system as recited in claim 1, wherein the slave injectors are configured and adapted to selectively inject at least natural gas and LCV fuel gas in a proportional mix.

17. A combustion system as recited in claim 1, wherein each slave injector has an outlet substantially in a common plane with the other slave injector outlets, and wherein the master injector includes a diverging outlet that sets the master injector back upstream from the common plane of the slave injectors.

* * * * *